US008045875B2

(12) United States Patent
Aoki et al.

(10) Patent No.: US 8,045,875 B2
(45) Date of Patent: Oct. 25, 2011

(54) IMAGE FORMING APPARATUS AND IMAGE FORMING METHOD CAPABLE OF GENERATING STABLE TRANSFER ELECTRIC FIELD

(75) Inventors: Shinji Aoki, Yokohama (JP); Haruo Iimura, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 395 days.

(21) Appl. No.: 12/267,677

(22) Filed: Nov. 10, 2008

(65) Prior Publication Data

US 2009/0123168 A1 May 14, 2009

(30) Foreign Application Priority Data

Nov. 14, 2007 (JP) ..... 2007-295110
May 12, 2008 (JP) ..... 2008-125090

(51) Int. Cl.
*G03G 15/16* (2006.01)

(52) U.S. Cl. ..... 399/66; 399/121; 399/197; 399/302

(58) Field of Classification Search ..... 399/66, 399/121, 297, 302
See application file for complete search history.

(56) References Cited

U.S. PATENT DOCUMENTS 5,041,877 A * 8/1991 Matsumoto ..... 399/66
7,215,898 B2 * 5/2007 Nishiwaki et al. ..... 399/66

FOREIGN PATENT DOCUMENTS

| | | |
|---|---|---|
| JP | 5-107944 | 4/1993 |
| JP | 5-297735 | 11/1993 |
| JP | 2704277 | 10/1997 |
| JP | 2003-35998 | 2/2003 |
| JP | 2003-302846 | 10/2003 |
| JP | 2004-69938 | 3/2004 |
| JP | 2005-4073 | 1/2005 |
| JP | 2006-113430 | 4/2006 |
| JP | 4083953 | 2/2008 |
| JP | 2008-65025 | 3/2008 |

* cited by examiner

*Primary Examiner* — David Gray
*Assistant Examiner* — G.M. Hyder
(74) *Attorney, Agent, or Firm* — Oblon, Spivak, McClelland, Maier & Neustadt, L.L.P.

(57) ABSTRACT

An image forming apparatus includes an image carrier for carrying a toner image and a transfer device. In the transfer device, a voltage applier applies a predetermined voltage to a transfer electric field generator. A potential measurement device measures a surface potential of the transfer electric field generator when a predetermined time period elapses after the voltage applier applies the predetermined voltage to the transfer electric field generator. A controller determines a transfer bias to be applied by at least one transfer member to the transfer electric field generator based on the measured surface potential of the transfer electric field generator. The at least one transfer member applies the transfer bias to the transfer electric field generator to generate a transfer electric field. The toner image is transferred from the image carrier onto a toner image receiver by the transfer electric field generated by the transfer electric field generator.

16 Claims, 13 Drawing Sheets

IMAGE FORMING APPARATUS AND IMAGE FORMING METHOD CAPABLE OF GENERATING STABLE TRANSFER ELECTRIC FIELD

CROSS-REFERENCE TO RELATED APPLICATIONS

The present application is based on and claims priority to Japanese Patent Application Nos. 2007-295110, filed on Nov. 14, 2007, and 2008-125090, filed on May 12, 2008 in the Japan Patent Office, the entire contents of each of which are hereby incorporated herein by reference.

BACKGROUND OF THE INVENTION

1. Field of the Invention

Exemplary aspects of the present invention relate to an image forming apparatus and an image forming method, and more particularly, to an image forming apparatus and an image forming method using the image forming apparatus for controlling a voltage of an electric field to transfer a toner image.

2. Description of the Related Art

Related-art image forming apparatuses, such as copiers, facsimile machines, printers, or multifunction printers having at least one of copying, printing, scanning, and facsimile functions, typically form a color image on a recording medium (e.g., a transfer sheet) based on image data using electrophotography. Thus, for example, chargers uniformly charge surfaces of image carriers. An optical writer emits light beams onto the charged surfaces of the image carriers to form electrostatic latent images on the image carriers according to the image data, respectively. Development devices supply yellow, cyan, magenta, and black toner particles to the electrostatic latent images formed on the image carriers to make the electrostatic latent images visible as yellow, cyan, magenta, and black toner images, respectively. A transfer member transfers the toner images directly from the image carriers and superimposes the toner images onto a transfer sheet conveyed on a conveyance belt in a direct transfer method to form a color toner image on the transfer sheet. Alternatively, a first transfer member transfers the toner images from the image carriers and superimposes the toner images onto an intermediate transfer member in an indirect transfer method to form a color toner image on the intermediate transfer member, and a second transfer member transfers the color toner image from the intermediate transfer member onto a transfer sheet. Cleaners clean the surfaces of the image carriers after the toner images are transferred from the image carriers. Finally, a fixing device applies heat and pressure to the transfer sheet bearing the color toner image to fix the color toner image on the transfer sheet, thus forming the color image on the transfer sheet.

In each of the direct transfer method and the indirect transfer method, the transfer member, including the first transfer member and the second transfer member, applies a transfer bias having a polarity either identical to or opposite to a polarity of the toner image to a transfer electric field generator, that is, the conveyance belt in the direct transfer method and the intermediate transfer member and the transfer sheet in the indirect transfer method, so as to generate a transfer electric field. An electrostatic attractive force or an electrostatic repulsive force generated by the transfer electric field transfers the toner image onto the intermediate transfer member or the transfer sheet.

The transfer member and the transfer electric field generator generally include a semi-conductive material whose resistance fluctuates with environmental conditions such as temperature and humidity. The resistance also changes gradually over time due to deterioration of the semi-conductive material. Accordingly, the transfer bias applied by the transfer member to the transfer electric field generator changes, resulting in decreased transfer efficiency and formation of a faulty toner image.

To address these problems, the transfer bias is adjusted to a predetermined constant voltage or a predetermined constant current by measuring a voltage or a current flowing in the transfer member contacting the transfer electric field generator or a surface potential of the transfer electric field generator, for example. However, such measurements may not be precise due to changes in speed of an image forming operation and measurement error caused by movement of the transfer electric field generator.

Obviously, such decreased transfer efficiency and its resulting formation of a faulty toner image are undesirable, and accordingly, there is a need for a technology to generate a stable transfer electric field regardless of change in resistance of the transfer electric field generator and the transfer member.

BRIEF SUMMARY OF THE INVENTION

This specification describes below an image forming apparatus according to an exemplary embodiment of the present invention. In one exemplary embodiment of the present invention, the image forming apparatus includes an image carrier configured to carry a toner image and a transfer device including at least one transfer member, a transfer electric field generator, a toner image receiver, a voltage applier, a potential measurement device, and a controller. The at least one transfer member is configured to apply a transfer bias. The transfer electric field generator is configured to receive the transfer bias applied by the at least one transfer member to generate a transfer electric field. The toner image receiver is configured to receive the toner image transferred from the image carrier by the transfer electric field generated by the transfer electric field generator. The voltage applier is configured to apply a predetermined voltage to the transfer electric field generator. The potential measurement device is configured to measure a surface potential of the transfer electric field generator when a predetermined time period elapses after the voltage applier applies the predetermined voltage to the transfer electric field generator. The controller is configured to determine the transfer bias to be applied by the at least one transfer member to the transfer electric field generator based on the measured surface potential of the transfer electric field generator.

This specification further describes below an image forming method according to an exemplary embodiment of the present invention. In one exemplary embodiment of the present invention, the image forming method includes carrying a toner image with an image carrier, applying a voltage to a transfer electric field generator with a voltage applier, and measuring a surface potential of the transfer electric field generator with a potential measurement device when a predetermined first time period elapses after the voltage applier applies the voltage to the transfer electric field generator. The image forming method further includes determining a transfer bias to be applied by at least one transfer member to the transfer electric field generator based on the measured surface potential of the transfer electric field generator, and applying the transfer bias to the transfer electric field generator with the at least one transfer member. The image forming method further includes generating a transfer electric field by the transfer bias applied by the at least one transfer member with the transfer electric field generator, and transferring the toner image from the image carrier onto a toner image receiver with the transfer electric field.

This specification further describes below an image forming method according to an exemplary embodiment of the present invention. In one exemplary embodiment of the present invention, the image forming method includes carrying a toner image with an image carrier, applying a voltage to a transfer electric field generator with a voltage application member serving as a voltage applier and contacting the transfer electric field generator, and measuring a surface potential of the transfer electric field generator with a potential measurement device when a predetermined first time period elapses after the voltage application member applies the voltage to the transfer electric field generator. The image forming method further includes connecting a constant-voltage power source to at least one transfer member using a switch to change the voltage applier from the voltage application member to the at least one transfer member, applying a voltage to the transfer electric field generator with the at least one transfer member, and measuring the surface potential of the transfer electric field generator again with the potential measurement device when a predetermined second time period elapses after the at least one transfer member applies the voltage to the transfer electric field generator. The image forming method further includes determining a transfer bias to be applied by the at least one transfer member to the transfer electric field generator based on the measured surface potentials of the transfer electric field generator that compensates for change in resistance of the at least one transfer member, and applying the transfer bias to the transfer electric field generator with the at least one transfer member. The image forming method further includes generating a transfer electric field by the transfer bias applied by the at least one transfer member with the transfer electric field generator, and transferring the toner image from the image carrier onto a toner image receiver with the transfer electric field.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
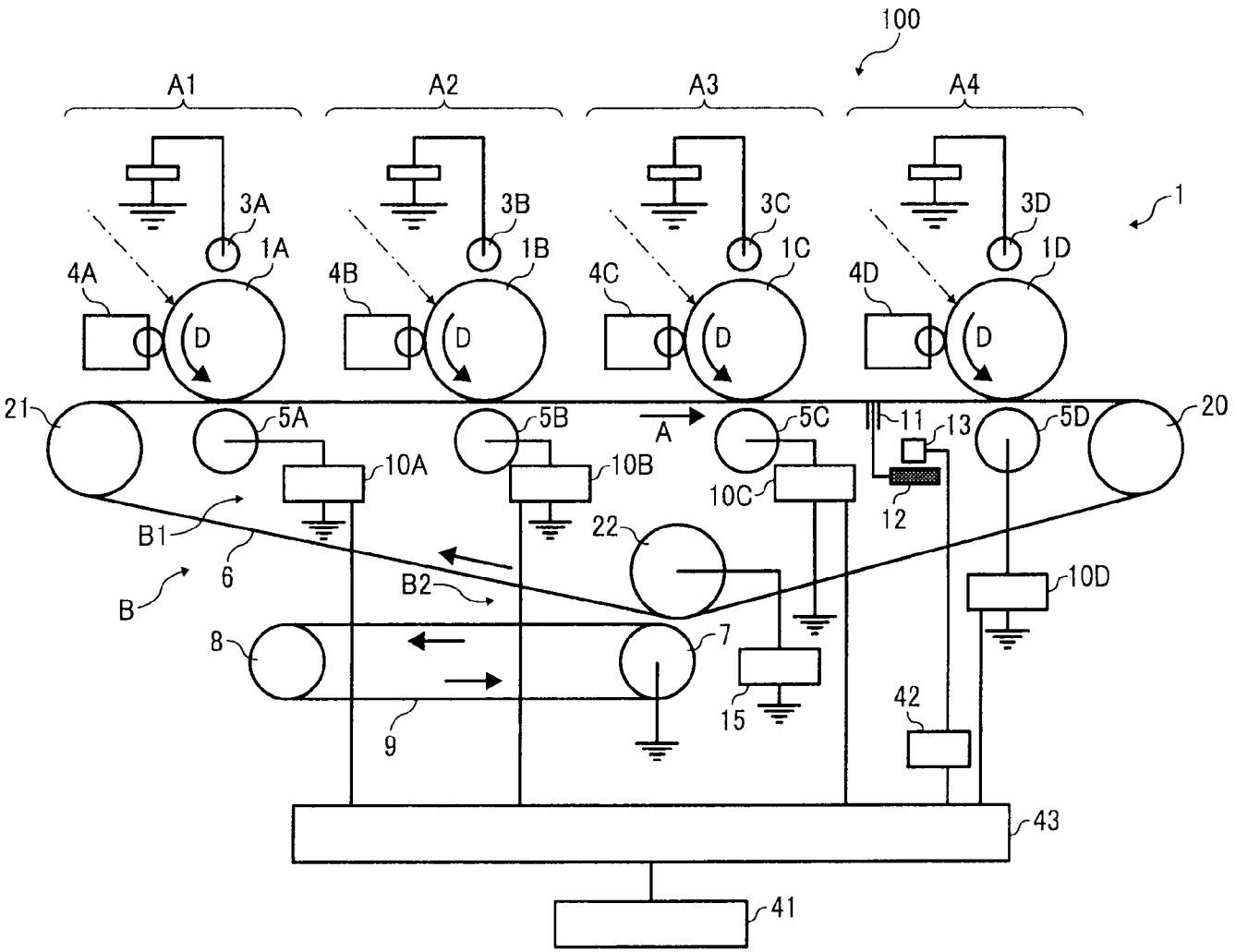
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes an image forming device 1, a timer 41, a recording member 42, and a controller 43. The image forming device 1 includes image forming units A1, A2, A3, and A4 and a transfer device B. The image forming units A1, A2, A3, and A4 include photoconductive drums 1A, 1B, 1C, and 1D, charging rollers 3A, 3B, 3C, and 3D, and development devices 4A, 4B, 4C, and 4D, respectively. The transfer device B includes a first transfer device B1, a second transfer device B2, a conductive brush 11, a metal plate 12, and a surface potential sensor 13. The first transfer device B1 includes an intermediate transfer belt 6, a driving roller 20, a driven roller 21, first transfer rollers 5A, 5B, 5C, and 5D, and power sources 10A, 10B, 10C, and 10D. The second transfer device B2 includes a second transfer belt 9, a second transfer roller 7, a driven roller 8, a counter roller 22, and a power source 15.

The image forming apparatus 100 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 100 functions as a tandem-type printer for forming a color image on a transfer material by electrophotography using an indirect transfer method.

In the image forming device 1, the four image forming units A1, A2, A3, and A4 form yellow, cyan, magenta, and black toner images, respectively. Specifically, the yellow, cyan, magenta, and black toner images are formed on outer circumferential surfaces of the photoconductive drums 1A, 1B, 1C, and 1D, respectively. The transfer device B transfers the yellow, cyan, magenta, and black toner images formed on the photoconductive drums 1A, 1B, 1C, and 1D onto a transfer sheet, serving as a transfer material, using the indirect transfer method.

The image forming apparatus 100 further includes an exposure device, a sheet supplier, and a fixing device. The sheet supplier includes a paper tray, a feeding roller, a friction pad, and a registration roller pair. Specifically, the exposure device, such as an LSU (laser scanning unit), emits laser beams onto the photoconductive drums 1A, 1B, 1C, and 1D based on image data sent from a personal computer, for example, to selectively expose the outer circumferential surfaces of the photoconductive drums 1A, 1B, 1C, and 1D, so as to form electrostatic latent images on the photoconductive drums 1A, 1B, 1C, and 1D, respectively. The sheet supplier supplies a transfer sheet to the transfer device B. Specifically, the paper tray loads and stores transfer sheets having a predetermined size, including paper and a resin sheet, such as an OHP (overhead projector) transparency. The feeding roller feeds the transfer sheets loaded on the paper tray one by one toward a conveyance path. The friction pad includes an elastomer and separates each transfer sheet from other transfer sheets. The registration roller pair feeds the transfer sheet to a second transfer nip formed between the intermediate transfer belt 6 and the second transfer belt 9 at a proper time. The fixing device includes a fixing roller and a pressing roller. The fixing roller and the pressing roller apply heat and pressure to the transfer sheet bearing a toner image to fix the toner image on the transfer sheet.

The image forming units A1, A2, A3, and A4 form a tandem structure in which the image forming units A1, A2, A3, and A4 are arranged in this order from an upstream toward a downstream in a rotating direction A of the intermediate transfer belt 6. The image forming units A1, A2, A3, and A4 form yellow, cyan, magenta, and black toner images, respectively, and have a common structure. For example, in the image forming unit A1, the charging roller 3A and the development device 4A surround the photoconductive drum 1A. The photoconductive drum 1A, serving as a latent image carrier and an image carrier, has a roller shape and rotates in a rotating direction D. The charging roller 3A opposes the photoconductive drum 1A without contacting the photoconductive drum 1A. The charging roller 3A applies a charging bias onto the outer circumferential surface of the photoconductive drum 1A to uniformly charge the outer circumferential surface of the photoconductive drum 1A. The charging roller 3A also cancels an electrostatic latent image formed on the photoconductive drum 1A after a toner image formed in correspondence to the electrostatic latent image is transferred from the photoconductive drum 1A to the intermediate transfer belt 6 to initialize the photoconductive drum 1A. The development device 4A applies a development bias to an electrostatic latent image formed on the photoconductive drum 1A by the exposure device to adhere yellow toner to the electrostatic latent image, so as to make the electrostatic latent image visible as a yellow toner image.

In the transfer device B, the first transfer device B1 applies a first transfer bias to the yellow toner image formed on the photoconductive drum 1A to transfer the yellow toner image onto the intermediate transfer belt 6 having an endless belt shape. Similarly, cyan, magenta, and black toner images are formed on the photoconductive drums 1B, 1C, and 1D, respectively, transferred from the photoconductive drums 1B, 1C, and 1D, and superimposed onto the yellow toner image on the intermediate transfer belt 6 to form a color toner image on the intermediate transfer belt 6. The second transfer device B2 applies a second transfer bias to the color toner image formed on the intermediate transfer belt 6 to transfer the color toner image onto the transfer sheet fed by the registration roller pair. The intermediate transfer belt 6 is looped over the driving roller 20 connected to and driven by a driver, the driven roller 21, and the counter roller 22. The driving roller 20 rotates the intermediate transfer belt 6 in the rotating direction A.

The first transfer rollers 5A, 5B, 5C, and 5D, serving as transfer members, contact an inner circumferential surface of the intermediate transfer belt 6 to apply first transfer biases to the intermediate transfer belt 6. The first transfer rollers 5A, 5B, 5C, and 5D oppose the photoconductive drums 1A, 1B, 1C, and 1D via the intermediate transfer belt 6, respectively. A contact-separate mechanism applies pressure to the inner circumferential surface of the intermediate transfer belt 6 to press the intermediate transfer belt 6 toward the photoconductive drums 1A, 1B, 1C, and 1D, so as to form first transfer nips between the intermediate transfer belt 6 and the photoconductive drums 1A, 1B, 1C, and 1D, respectively. The first transfer rollers 5A, 5B, 5C, and 5D are electrically connected to the power sources 10A, 10B, 10C, and 10D, serving as constant-voltage power sources, respectively, via a conductive material, and grounded. The first transfer rollers 5A, 5B, 5C, and 5D apply first transfer biases onto the inner circumferential surface (e.g., a back surface) of the intermediate transfer belt 6, serving as a transfer electric field generator, to generate a transfer electric field having a polarity opposite to a polarity of the yellow, cyan, magenta, and black toner images formed on the photoconductive drums 1A, 1B, 1C, and 1D at the first transfer nips, respectively. Accordingly, an electrostatic attractive force transfers the yellow, cyan, magenta, and black toner images from the photoconductive drums 1A, 1B, 1C, and 1D onto an outer circumferential surface (e.g., a front surface) of the intermediate transfer belt 6.

In the second transfer device B2, the second transfer roller 7, serving as a driving roller, is connected to a driver. The second transfer belt 9, having an endless belt shape and serving as a conveyance belt, is looped over the second transfer roller 7 and the driven roller 8. The second transfer belt 9 contacts the intermediate transfer belt 6 at a position between the second transfer roller 7 and the counter roller 22 to form a second transfer nip. The power source 15, serving as a constant-voltage power source, is electrically connected to the counter roller 22 via a conductive material, and grounded. The counter roller 22, serving as a transfer member, applies a second transfer bias onto the inner circumferential surface of the intermediate transfer belt 6, serving as a transfer electric field generator, to generate a transfer electric field having a polarity identical to a polarity of the color toner image formed on the intermediate transfer belt 6 at the second transfer nip. Accordingly, an electrostatic repulsive force transfers the color toner image from the intermediate transfer belt 6 onto the transfer sheet conveyed to the second transfer nip. Alternatively, the second transfer roller 7, instead of the counter roller 22, may apply a second transfer bias to generate a transfer electric field having a polarity opposite to the polarity of the color toner image formed on the intermediate transfer belt 6.

In the transfer device B, the conductive brush 11, the metal plate 12, and the surface potential sensor 13, which serve as a potential measurement device, are provided between the first transfer rollers 5C and 5D. The metal plate 12 has a rectangular plate shape and is connected to the conductive brush 11, serving as a conductor, via a conductive material. The surface potential sensor 13 is provided with respect to the metal plate 12 in such a manner that a predetermined gap is provided between the surface potential sensor 13 and the metal plate 12, and measures a surface potential of the intermediate transfer belt 6 without contacting the intermediate transfer belt 6.

The timer 41 counts a time period elapsed after the power source 10C, serving as a voltage applier, starts applying a voltage. The recording member 42 includes a memory and an AD board, for example, and records the surface potential of the intermediate transfer belt 6 measured by the surface potential sensor 13 together with the time period counted by the timer 41. The controller 43 includes a CPU (central processing unit) and controls the timer 41 and the recording member 42. The power sources 10A, 10B, 10C, and 10D are connected to the controller 43. The surface potential sensor 13 is connected to the controller 43 via the recording member 42. The controller 43 recognizes the measured surface potential of the intermediate transfer belt 6 recorded by the recording member 42 together with the time period counted by the timer 41 as a function of time. Alternatively, the controller 43 recognizes the measured surface potential of the intermediate transfer belt 6 as an increasing speed of the surface potential of the intermediate transfer belt 6.

Figure 2:
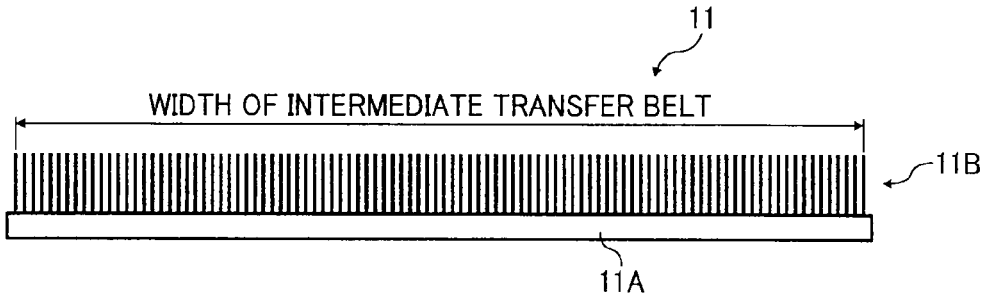
FIG. 2 is a schematic view of a conductive brush included in the image forming apparatus shown in FIG. 1.

FIG. 2 is a schematic view of the conductive brush 11. The conductive brush 11 includes an aluminum plate 11A and a conductive fiber 11B. The aluminum plate 11A has a substantially rectangular plate shape and serves as a base. The conductive fiber 11B includes a nylon resin containing carbon black and is implanted on the aluminum plate 11A. Points of the conductive fiber 11B contact the inner circumferential surface of the intermediate transfer belt 6 depicted in FIG. 1 across substantially a full width of the intermediate transfer belt 6, that is, a direction perpendicular to the rotating direction A of the intermediate transfer belt 6. The conductive brush 11 is connected to the metal plate 12 depicted in FIG. 1 in such a manner that the aluminum plate 11A is connected to the metal plate 12 via a conductive wire serving as a conductive material.

Alternatively, the conductive fiber 11B may include a resin other than the nylon resin or a metal. A conductive sponge material, such as urethane in which carbon black is dispersed, may replace the conductive brush 11. In order to prevent the intermediate transfer belt 6 from being worn by the conductive brush 11 or the conductive sponge, the conductive brush 11 or the conductive sponge may separate from the intermediate transfer belt 6 during an image forming operation.

Referring to FIG. 1, the following describes an image forming operation for forming a color image on a transfer sheet, which is performed by the image forming device 1 of the image forming apparatus 100.

When the image forming device 1 starts an image forming operation, the photoconductive drums 1A, 1B, 1C, and 1D rotate in the rotating direction D. The charging rollers 3A, 3B, 3C, and 3D uniformly charge the outer circumferential surfaces of the photoconductive drums 1A, 1B, 1C, and 1D, respectively, to have a predetermined polarity. The exposure device emits laser beams onto the charged surfaces of the photoconductive drums 1A, 1B, 1C, and 1D according to yellow, cyan, magenta, and black image data to form electrostatic latent images on the outer circumferential surfaces of the photoconductive drums 1A, 1B, 1C, and 1D, serving as latent image carriers and image carriers, respectively. The development devices 4A, 4B, 4C, and 4D make the electrostatic latent images formed on the photoconductive drums 1A, 1B, 1C, and 1D visible as yellow, cyan, magenta, and black toner images, respectively. The first transfer rollers 5A, 5B, 5C, and 5D, serving as transfer members, apply first transfer biases to the intermediate transfer belt 6, serving as a transfer electric field generator, to generate a transfer electric field having a polarity opposite to a polarity of the yellow, cyan, magenta, and black toner images formed on the photoconductive drums 1A, 1B, 1C, and 1D at the first transfer nips, respectively. Accordingly, an electrostatic attractive force transfers the yellow, cyan, magenta, and black toner images formed on the photoconductive drums 1A, 1B, 1C, and 1D onto the intermediate transfer belt 6, serving as a toner image receiver, in such a manner that the yellow, cyan, magenta, and black toner images are superimposed on the intermediate transfer belt 6, respectively, to form a color toner image on the intermediate transfer belt 6, serving as an image carrier. At the second transfer nip formed between the intermediate transfer belt 6 and the second transfer belt 9, the counter roller 22, serving as a transfer member, applies a second transfer bias to the intermediate transfer belt 6, serving as a transfer electric field generator, to generate a transfer electric field having a polarity identical to a polarity of the color toner image formed on the intermediate transfer belt 6. An electrostatic repulsive force generated by the transfer electric field transfers the color toner image from the intermediate transfer belt 6 onto a transfer sheet, supplied by the sheet supplier and serving as a toner image receiver. Alternatively, when the image forming device 1 forms a monochrome image, the image forming device 1 performs an image forming operation by using only a predetermined photoconductive drum (e.g., the photoconductive drum 1D for forming a black toner image).

Figure 3:
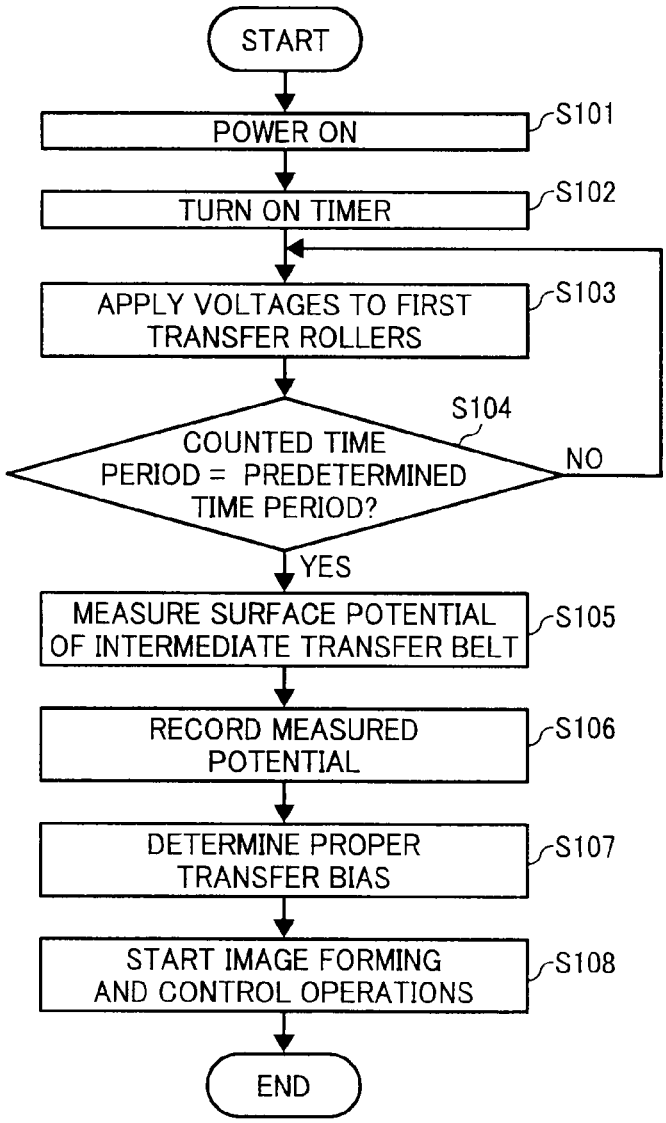
FIG. 3 is a flowchart illustrating a process for determining a proper transfer bias in the image forming apparatus shown in FIG. 1.

Referring to FIGS. 1 and 3, the following describes a process for determining a proper transfer bias voltage (hereinafter referred to as a proper transfer bias) in the image forming apparatus 100 depicted in FIG. 1. FIG. 3 is a flowchart illustrating the process for determining the proper transfer bias in the image forming apparatus 100.

In step S101, the image forming apparatus 100 is powered on. In step S102, the timer 41 is turned on to start counting a time period. In step S103, before the image forming apparatus 100 starts an image forming operation, that is, when the photoconductive drums 1A, 1B, 1C, and 1D, the first transfer rollers 5A, 5B, 5C, and 5D, and the intermediate transfer belt 6 stop rotating, the power sources 10C and 10D, serving as constant-voltage power sources, apply predetermined voltages, for example, 1,000 V and 0 V, to the first transfer rollers 5C and 5D, respectively. Simultaneously, the first transfer rollers 5C and 5D apply the voltages to the intermediate transfer belt 6, respectively. In step S104, the controller 43 determines whether or not the time period counted by the timer 41 reaches a predetermined time period (e.g., 1.0 second). For example, the controller 43 determines whether or not a predetermined time period elapses after the first transfer rollers 5C and 5D apply the voltages to the intermediate transfer belt 6, respectively. When the time period counted by the timer 41 reaches the predetermined time period, that is, when YES is selected in step S104, the surface potential sensor 13 measures a surface potential of the intermediate transfer belt 6 via the conductive brush 11 and the metal plate 12 in step S105. In step S106, the recording member 42 records the measured surface potential of the intermediate transfer belt 6. In step S107, the controller 43 calculates and determines a proper transfer bias to be applied by the first transfer rollers 5A, 5B, 5C, and 5D to transfer a toner image at which the image forming apparatus 100 can provide proper transfer efficiency and image quality. In step S108, the image forming apparatus 100 starts an image forming operation or other control operation.

In the flowchart shown in FIG. 3, the surface potential sensor 13 measures the surface potential of the intermediate transfer belt 6 when the intermediate transfer belt 6 does not rotate. Alternatively, the surface potential sensor 13 may measure the surface potential of the intermediate transfer belt 6 when the intermediate transfer belt 6 rotates at a speed slower than a speed at which the intermediate transfer belt 6 rotates during the image forming operation. In this case, measurement error may increase. Therefore, it is preferable to measure the surface potential of the intermediate transfer belt 6 when the intermediate transfer belt 6 stops rotating.

Figure 4:
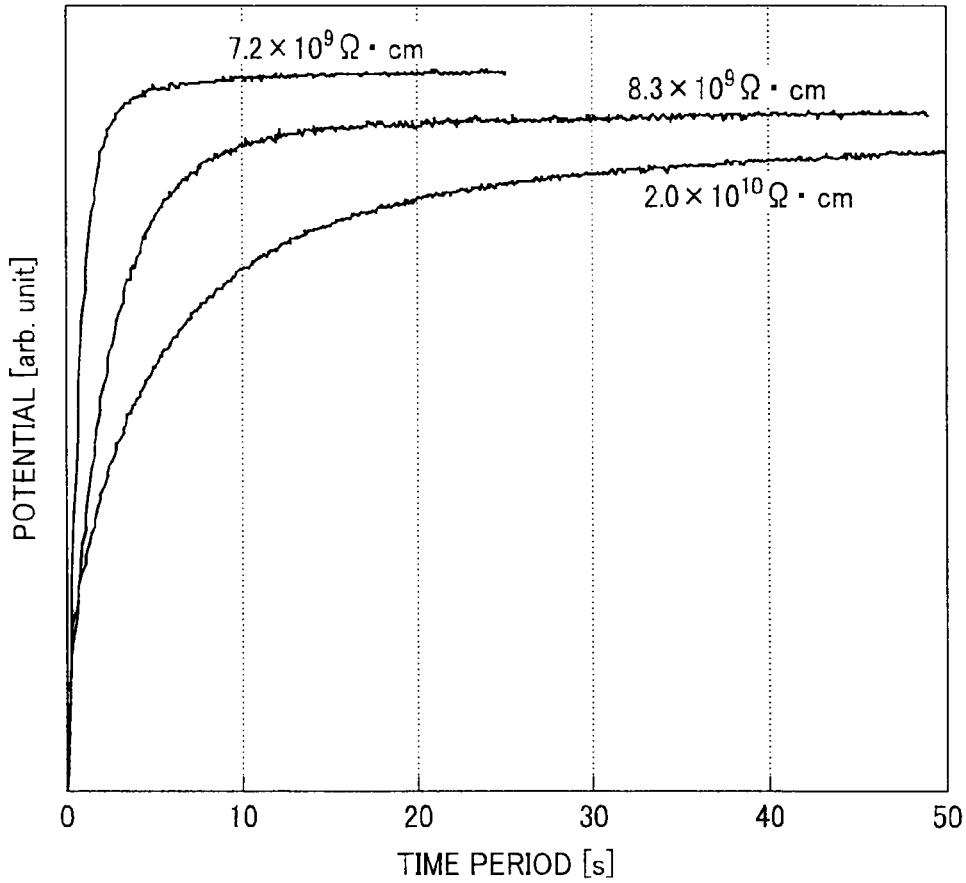
FIG. 4 is a graph illustrating a relation between a time period and a surface potential of three types of an intermediate transfer belt included in the image forming apparatus shown in FIG. 1.

FIG. 4 is a graph illustrating the surface potential of the intermediate transfer belts 6 changing over time when the intermediate transfer belts 6 have three different volume resistivities, which are $7.2\times10^{9}$ Ω·cm, $8.3\times10^{9}$ Ω·cm, and $2.0\times10^{10}$ Ω·cm, respectively. In a test machine equivalent to the image forming apparatus 100, the first transfer rollers 5C and 5D applied transfer bias voltages of 1,000 V and 0 V, respectively, and the surface potential sensor 13 measured the surface potential of the intermediate transfer belts 6 having the three different volume resistivities, respectively, whenever a predetermined time period elapsed. In the graph shown in FIG. 4, a horizontal axis represents the elapsed time period and a vertical axis represents the measured surface potential of the intermediate transfer belt 6. The volume resistivities of the intermediate transfer belts 6 were measured at an applied voltage of 100 V with a resistivity meter HIRESTA-UP MCP-HT450 available from Mitsubishi Chemical Corporation according to Japanese Industrial Standards JIS K6911. As illustrated in FIG. 4, even when the difference among the three different volume resistivities is very small, an increasing speed and a saturated value (e.g., a saturated potential) of the surface potential of the intermediate transfer belt 6 substantially vary depending on the volume resistivity. For example, the lower the volume resistivity, the greater the increasing speed and the saturated value of the surface potential of the intermediate transfer belt 6. Accordingly, a surface resistivity of the intermediate transfer belt 6 can be predicted by measuring the increasing speed and the saturated value of the surface potential of the intermediate transfer belt 6 or a potential of the intermediate transfer belt 6 when a predetermined time period elapses after voltages are applied to the first transfer rollers 5C and 5D, respectively. In other words, a test model of the image forming apparatus 100 examines in advance a relation between the measured potential or the surface resistivity of the intermediate transfer belt 6 and the proper transfer bias for transferring a toner image. The proper transfer bias for forming an image is determined based on such relation and the measured potential of the intermediate transfer belt 6. Thus, the image forming apparatus 100 can provide an improved robustness against change in resistivity of the intermediate transfer belt 6.

Figure 5A:
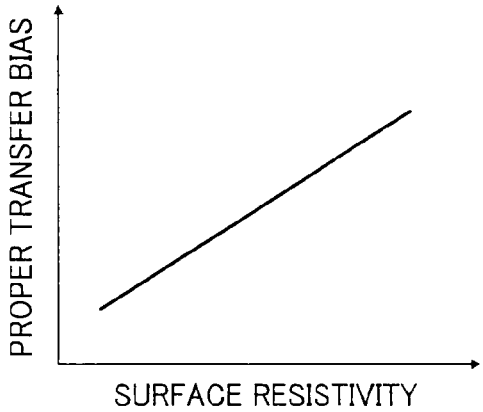
FIG. 5A is a graph illustrating a relation between a surface resistivity of the intermediate transfer belt shown in FIG. 1 and a proper transfer bias.
Figure 5B:
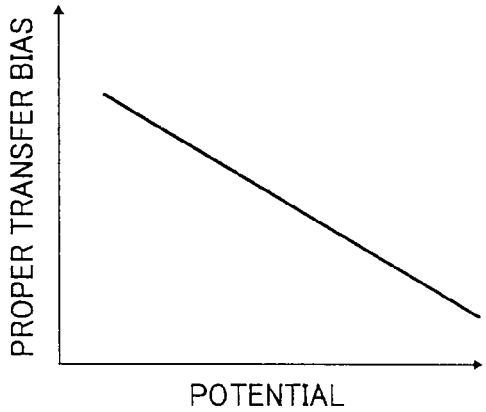
FIG. 5B is a graph illustrating a relation between a measured potential of the intermediate transfer belt shown in FIG. 1 and a proper transfer bias.

FIG. 5A is a graph illustrating a relation between the surface resistivity of the intermediate transfer belt 6 and the proper transfer bias. FIG. 5B is a graph illustrating a relation between the measured potential of the intermediate transfer belt 6 and the proper transfer bias. The graph shown in FIG. 5A illustrates a general relation between the surface resistivity of the intermediate transfer belt 6 and the proper transfer bias, which is obtained by the above-described examinations. Similarly, the graph shown in FIG. 5B illustrates a general relation between the measured potential of the intermediate transfer belt 6 and the proper transfer bias, which is obtained by the above-described examinations. FIG. 5A shows a linear relation in which the surface resistivity of the intermediate transfer belt 6 and the proper transfer bias are directly proportional. FIG. 5B shows a linear relation in which the measured potential of the intermediate transfer belt 6 and the proper transfer bias are inversely proportional.

As illustrated in FIG. 4, when the intermediate transfer belt 6 has a volume resistivity of about $10^{10}$ Ω·cm, several tens of seconds are needed to saturate the potential of the intermediate transfer belt 6 after the first transfer roller 5C applies a voltage. The time period needed to saturate the potential of the intermediate transfer belt 6 also varies depending on the volume resistivity of the intermediate transfer belt 6. Therefore, according to this exemplary embodiment, the recording member 42 records the potential of the intermediate transfer belt 6 measured when one second elapses after a voltage is applied to the first transfer roller 5C, and the proper transfer bias is determined based on the recorded potential of the intermediate transfer belt 6, thereby shortening a time period needed for the image forming apparatus 100 to start an image forming operation after powered on. Namely, the earlier the potential of the intermediate transfer belt 6 is measured, the shorter the time period needed to start the image forming operation. However, when the potential of the intermediate transfer belt 6 increases within an excessively short time period at a high speed, measurement error may increase. To address this, a time for measuring the surface potential of the intermediate transfer belt 6 can be properly set according to the volume resistivity of the intermediate transfer belt 6 and variation of the volume resistivity due to an environmental factor.

The surface potential of the intermediate transfer belt 6 can be measured once or a plurality of times. The surface resistivity of the intermediate transfer belt 6 can be predicted with an improved precision based on the potential increasing speed and curve of the intermediate transfer belt 6 recorded by the recording member 42.

Figure 6A:
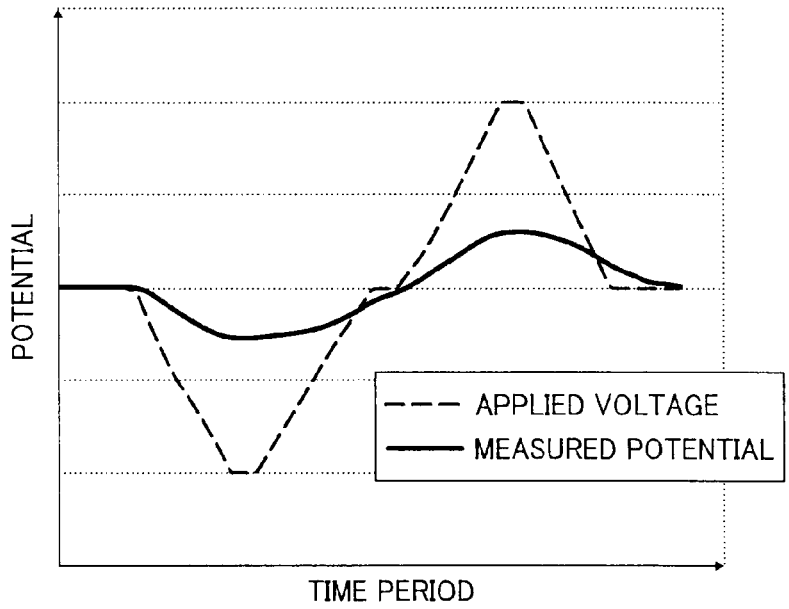
FIG. 6A is a graph illustrating a relation between a time period and an applied voltage of the intermediate transfer belt shown in FIG. 1 and between a time period and a measured potential of the intermediate transfer belt.
Figure 6B:
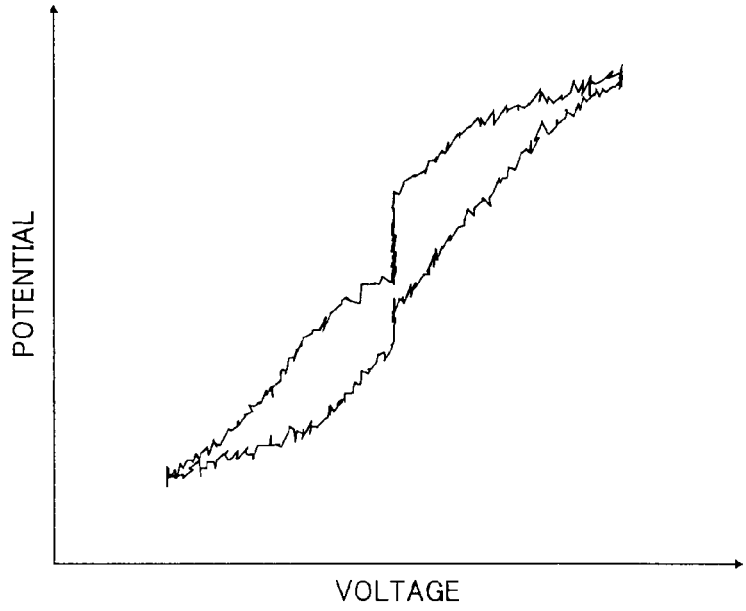
FIG. 6B is a graph illustrating a relation between an applied voltage of the intermediate transfer belt shown in FIG. 1 and a measured potential of the intermediate transfer belt.

FIG. 6A is a graph illustrating a relation between a time period and an applied voltage of the intermediate transfer belt 6 and between a time period and a measured potential of the intermediate transfer belt 6. FIG. 6B is a graph illustrating a relation between an applied voltage and a measured potential of the intermediate transfer belt 6. When the applied voltage changes, an electric charge remaining on the intermediate transfer belt 6 generates hysteresis in a potential increasing curve. Therefore, the surface resistivity of the intermediate transfer belt 6 can be predicted based on a shape of a curve plotted by the applied voltages and the measured potentials of the intermediate transfer belt 6. Especially, when the intermediate transfer belt 6 includes an electron conduction material such as a carbon dispersion material, a resistance of the intermediate transfer belt 6 is affected by an electric field. Therefore, the applied voltage is changed to measure the potential of the intermediate transfer belt 6. The recording member 42 records the measured potential of the intermediate transfer belt 6 together with the time period counted by the timer 41. The controller 43 recognizes the measured potential of the intermediate transfer belt 6 as a function of time, and compares the recognized potential of the intermediate transfer belt 6 with data obtained in advance by an experiment, for example, so as to determine the proper transfer bias.

Figure 7:
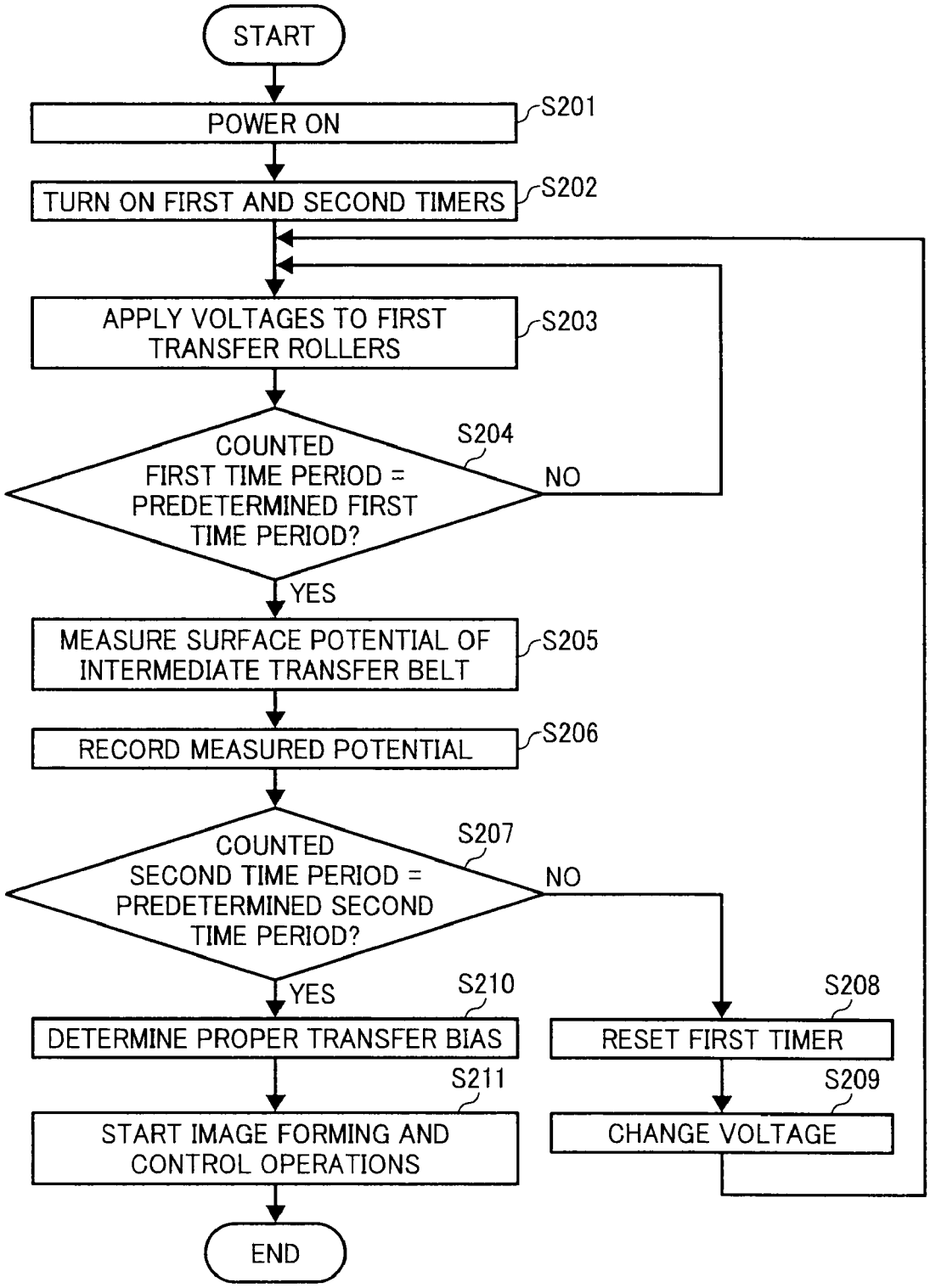
FIG. 7 is a flowchart illustrating a process for determining a proper transfer bias when a voltage applied to the intermediate transfer belt shown in FIG. 1 changes whenever a predetermined time period elapses.

Referring to FIGS. 1 and 7, the following describes another process for determining a proper transfer bias in the image forming apparatus 100 depicted in FIG. 1. FIG. 7 is a flowchart illustrating the process for determining the proper transfer bias when a voltage applied to the intermediate transfer belt 6 changes whenever a predetermined time period elapses.

In step S201, the image forming apparatus 100 is powered on. In step S202, first and second timers equivalent to the timer 41 are turned on to start counting a time period. In step S203, before the image forming apparatus 100 starts an image forming operation, that is, when the photoconductive drums 1A, 1B, 1C, and 1D, the first transfer rollers 5A, 5B, 5C, and 5D, and the intermediate transfer belt 6 stop rotating, the power sources 10C and 10D, serving as constant-voltage power sources, apply predetermined voltages to the first transfer rollers 5C and 5D, respectively. Simultaneously, the first transfer rollers 5C and 5D apply the voltages to the intermediate transfer belt 6, respectively. In step S204, the controller 43 determines whether or not the time period counted by the first timer reaches a predetermined first time period. For example, the controller 43 determines whether or not a predetermined first time period elapses after the first transfer rollers 5C and 5D apply the voltages to the intermediate transfer belt 6, respectively. When the time period counted by the first timer reaches the predetermined first time period, that is, when YES is selected in step S204, the surface potential sensor 13 measures a surface potential of the intermediate transfer belt 6 via the conductive brush 11 and the metal plate 12 in step S205. In step S206, the recording member 42 records the measured surface potential of the intermediate transfer belt 6. In step S207, the controller 43 determines whether or not the time period counted by the second timer reaches a predetermined second time period. For example, the controller 43 determines whether or not a predetermined second time period elapses after the first transfer rollers 5C and 5D apply the voltages to the intermediate transfer belt 6, respectively. When the time period counted by the second timer does not reach the predetermined second time period, that is, when NO is selected in step S207, the first timer is reset in step S208. In step S209, a voltage applied to measure the potential of the intermediate transfer belt 6, that is, a voltage applied by the first transfer roller 5C, is changed in step S209. When the time period counted by the second timer reaches the predetermined second time period, that is, when YES is selected in step S207, the controller 43 calculates and determines a proper transfer bias to be applied by the first transfer rollers 5A, 5B, 5C, and 5D in step S210. In step S211, the image forming apparatus 100 starts an image forming operation or other control operation.

Determining the proper transfer bias as described above changes the potential of the intermediate transfer belt 6 transiently. Further, a material included in the intermediate transfer belt 6 causes an electric field to affect the resistance of the intermediate transfer belt 6. Considering those, the potential of the intermediate transfer belt 6 is measured by changing the voltage applied to the intermediate transfer belt 6, and the surface resistivity of the intermediate transfer belt 6 is predicted based on a potential change curve recorded by the recording member 42 with an improved precision. In other words, even when the intermediate transfer belt 6 includes an electron conduction material such as a carbon dispersion material, the controller 43 can determine the proper transfer bias with an improved precision.

The process shown in FIG. 7 uses two timers. Alternatively, the process shown in FIG. 7 may use a single timer.

The surface resistivity of the intermediate transfer belt 6 may be predicted based on an electric current flowing between the first transfer rollers 5C and 5D. However, in general image forming apparatuses using electrophotography, an electric current in an amount of about 1 μA flows between the first transfer rollers 5C and 5D. Therefore, a high-precision ammeter may be needed or measurement error may increase. To address this, in the image forming apparatus 100 according to this exemplary embodiment, the surface potential sensor 13, that is, a non-contact type sensor, measures the surface potential of the intermediate transfer belt 6. When the non-contact type sensor is used, an electric charge does not escape from the intermediate transfer belt 6. Further, the non-contact type sensor can measure a slight amount of electric charges as a great potential by decreasing an amount of electrostatic charges around a measurement area on the intermediate transfer belt 6.

The surface potential sensor 13 may be provided near the outer circumferential surface or the inner circumferential surface of the intermediate transfer belt 6. In this case, the surface potential sensor 13 measures a small area on the intermediate transfer belt 6. Further, variation in the surface resistivity of the intermediate transfer belt 6 or toner particles on the intermediate transfer belt 6 may degrade sensitivity of the surface potential sensor 13. To address this, according to this exemplary embodiment, the conductive brush 11 contacts the inner circumferential surface of the intermediate transfer belt 6 across substantially the full width of the intermediate transfer belt 6. The conductive brush 11 is connected to the metal plate 12 via the conductive wire, so that the surface potential sensor 13 measures the potential of the metal plate 12. Thus, the surface potential sensor 13 can measure an average potential of the intermediate transfer belt 6 properly. An experiment performed by locating the image forming apparatus 100 in an environmental condition of high temperature and humidity, an environmental condition of ambient temperature and humidity, and an environmental condition of low temperature and humidity revealed that the image forming apparatus 100 could provide high transfer efficiency and high image quality under such various environmental conditions.

According to this exemplary embodiment, the first transfer rollers 5C and 5D serve as voltage appliers for applying a voltage to the intermediate transfer belt 6. Alternatively, the first transfer rollers 5A and 5B may serve as the voltage appliers. Yet alternatively, the photoconductive drums 1A, 1B, 1C, and 1D or other members may apply a voltage to the intermediate transfer belt 6.

Further, according to this exemplary embodiment, the surface potential sensor 13 is provided at a position between the first transfer rollers 5C and 5D to measure the potential of the intermediate transfer belt 6. Alternatively, the surface potential sensor 13 may be provided at a position between adjacent stations (e.g., the image forming units A1, A2, A3, and A4), a position upstream from the first transfer roller 5A in the rotating direction A of the intermediate transfer belt 6, a position downstream from the first transfer roller 5D in the rotating direction A of the intermediate transfer belt 6, or a position near the counter roller 22, so as to provide effects equivalent to the effects provided by the surface potential sensor 13 disposed between the first transfer rollers 5C and 5D.

Figure 8:
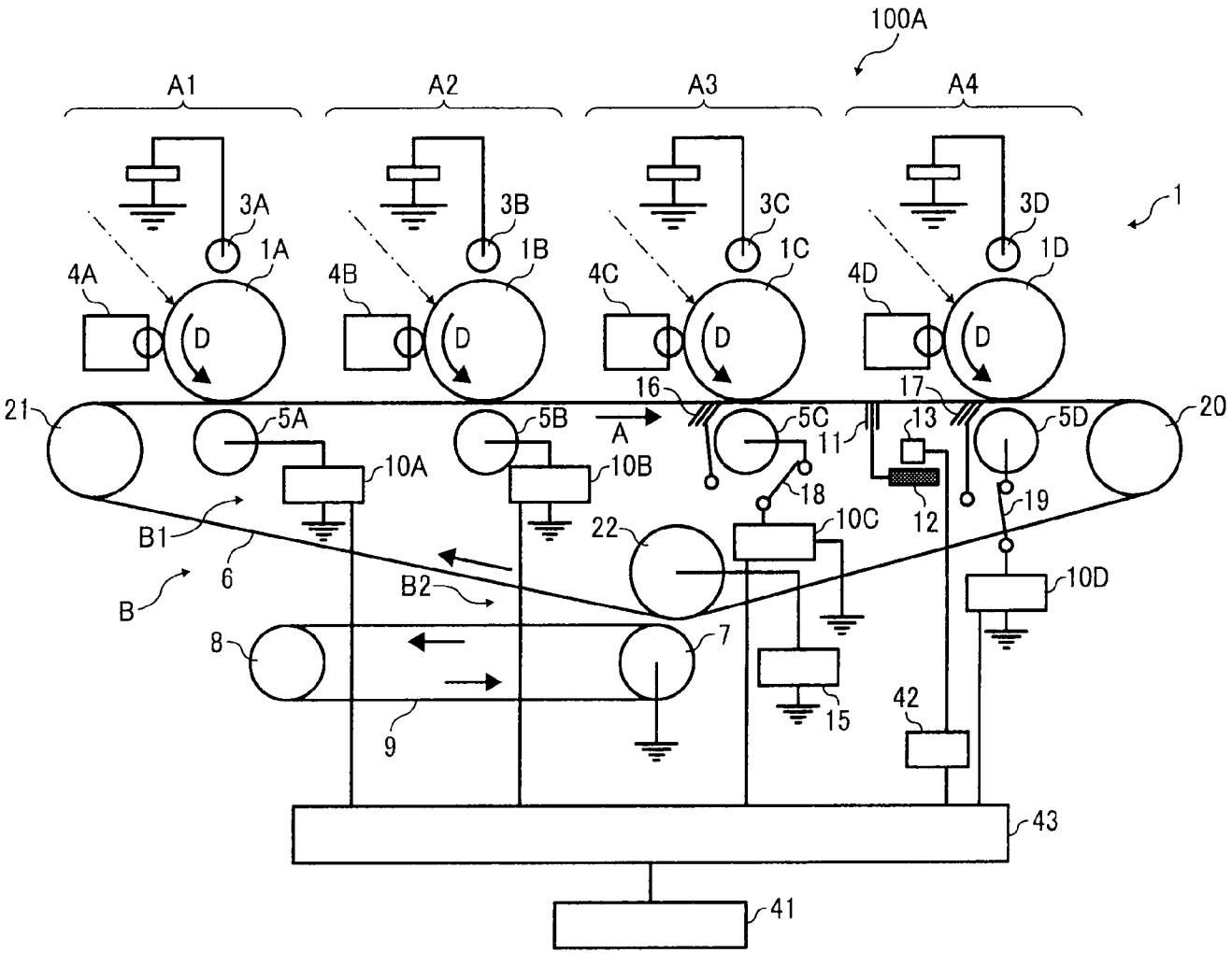
FIG. 8 is a schematic view of an image forming apparatus according to another exemplary embodiment of the present invention.

Referring to FIG. 8, the following describes an image forming apparatus 100A according to another exemplary embodiment. FIG. 8 is a schematic view of the image forming apparatus 100A. The image forming apparatus 100A includes conductive brushes 16 and 17 and switches 18 and 19. The other elements of the image forming apparatus 100A are common to the image forming apparatus 100 depicted in FIG. 1.

The conductive brushes 16 and 17, serving as voltage application members, apply a voltage to the intermediate transfer belt 6. The switch 18 turns on and off a bias supplied to the conductive brush 16 and the first transfer roller 5C. The switch 19 turns on and off a bias supplied to the conductive brush 17 and the first transfer roller 5D. The conductive brush 16 is provided upstream from the first transfer roller 5C in the rotating direction A of the intermediate transfer belt 6. Points of a conductive fiber of the conductive brush 16 contact the inner circumferential surface (e.g., the back surface) of the intermediate transfer belt 6. Similarly, the conductive brush 17 is provided upstream from the first transfer roller 5D in the rotating direction A of the intermediate transfer belt 6. The conductive brushes 16 and 17 have a structure substantially equivalent to the structure of the conductive brush 11 shown in FIG. 2. Specifically, an aluminum plate equivalent to the aluminum plate 11A has a substantially rectangular plate shape and serves as a base. A conductive fiber equivalent to the conductive fiber 11B includes a nylon resin containing carbon black and is implanted on the aluminum plate. The switch 18 selectively connects the power source 10C to the first transfer roller 5C or the conductive brush 16. Similarly, the switch 19 selectively connects the power source 10D to the first transfer roller 5D or the conductive brush 17.

Figure 9:
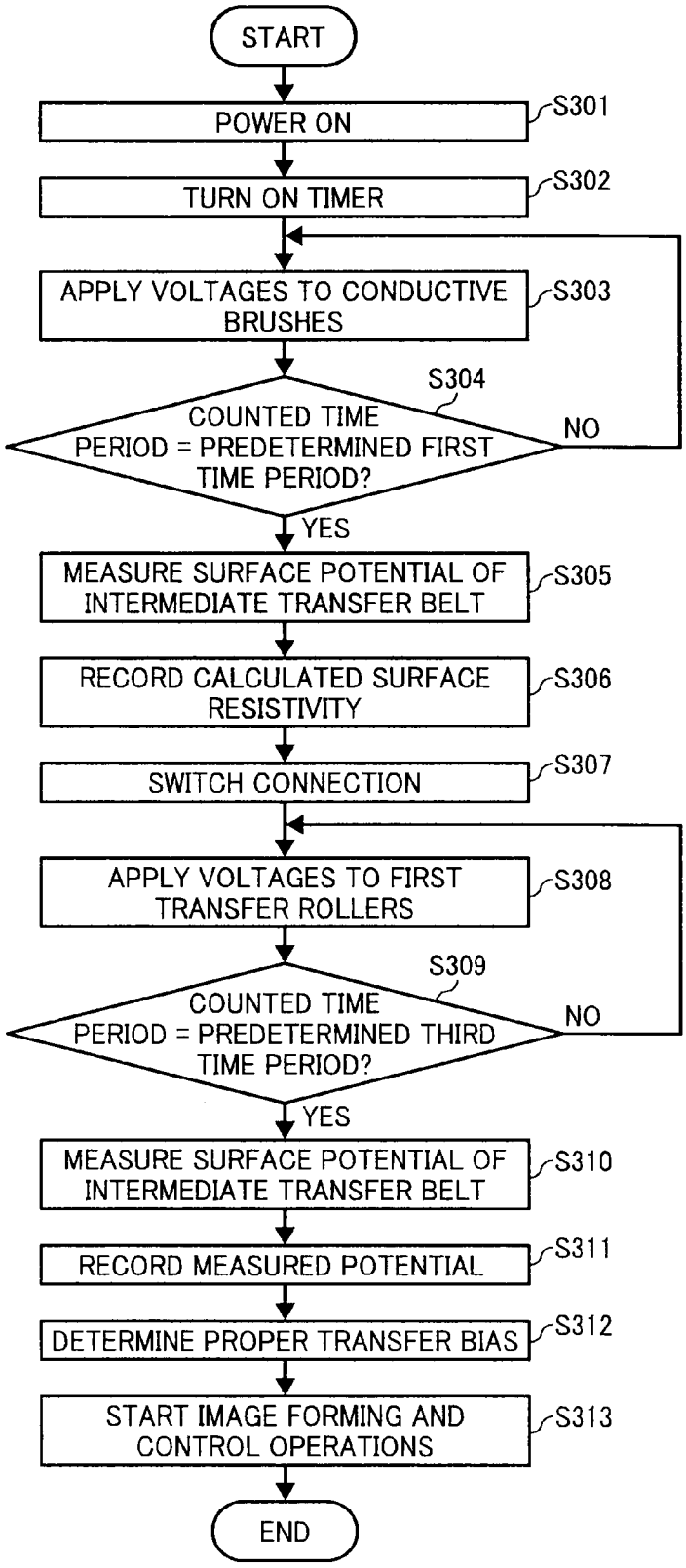
FIG. 9 is a flowchart illustrating a process for determining a proper transfer bias in the image forming apparatus shown in FIG. 8.

Referring to FIGS. 8 and 9, the following describes a process for determining a proper transfer bias in the image forming apparatus 101A depicted in FIG. 8. FIG. 9 is a flowchart illustrating the process for determining the proper transfer bias in the image forming apparatus 100A. An image forming operation performed by the image forming apparatus 100A is common to the image forming operation performed by the image forming apparatus 100 depicted in FIG. 1, and thereby the description of the image forming operation is omitted.

In step S301, the image forming apparatus 100A is powered on. In step S302, the timer 41 is turned on to start counting a time period. In step S303, before the image forming apparatus 100A starts an image forming operation, that is, when the photoconductive drums 1A, 1B, 1C, and 1D, the first transfer rollers 5A, 5B, 5C, and 5D, and the intermediate transfer belt 6 stop rotating, the power sources 10C and 10D, serving as constant-voltage power sources, apply predetermined voltages, for example, 1,000 V and 0 V, to the conductive brushes 16 and 17, respectively. Accordingly, the conductive brushes 16 and 17 apply the voltages to the intermediate transfer belt 6, respectively. In step S304, the controller 43 determines whether or not the time period counted by the timer 41 reaches a predetermined first time period. For example, the controller 43 determines whether or not a predetermined first time period elapses after the conductive brushes 16 and 17 apply the voltages to the intermediate transfer belt 6, respectively. When the time period counted by the timer 41 reaches the predetermined first time period, that is, when YES is selected in step S304, the surface potential sensor 13 measures a surface potential of the intermediate transfer belt 6 in step S305. In step S306, the controller 43 calculates a surface resistivity of the intermediate transfer belt 6 based on the measured surface potential of the intermediate transfer belt 6 and a relation between a prerecorded potential and the surface resistivity of the intermediate transfer belt 6, and the recording member 42 records the calculated surface resistivity of the intermediate transfer belt 6. In step S307, the switches 18 and 19 are turned on to connect the power sources 10C and 10D to the first transfer rollers 5C and 5D, respectively. In step S308, the power sources 10C and 10D apply predetermined voltages to the first transfer rollers 5C and 5D, respectively. Accordingly, the first transfer rollers 5C and 5D apply the voltages to the intermediate transfer belt 6, respectively. In step S309, the controller 43 determines whether or not the time period counted by the timer 41 after the timer 41 is turned on in step S302 reaches a predetermined third time period. Alternatively, the controller 43 determines whether or not a predetermined third time period elapses after the first transfer rollers 5C and 5D apply the voltages to the intermediate transfer belt 6, respectively. When the time period counted by the timer 41 reaches the predetermined third time period, that is, when YES is selected in step S309, the surface potential sensor 13 measures the surface potential of the intermediate transfer belt 6 again in step S310. In step S311, the recording member 42 records the measured surface potential of the intermediate transfer belt 6. In step S312, the controller 43 calculates and determines a proper transfer bias to be applied by the first transfer rollers 5A, 5B, 5C, and 5D to transfer a toner image at which the image forming apparatus 100A can provide proper transfer efficiency and image quality. In step S313, the image forming apparatus 100A starts an image forming operation or other control operation.

According to this exemplary embodiment, the surface potential of the intermediate transfer belt 6 affected by a resistance of the first transfer rollers 5C and 5D or the surface potential of the intermediate transfer belt 6 changing over time is measured and recorded. On the other hands, when the recording member 42 records in advance relations between the proper transfer bias and the potential of the intermediate transfer belt 6 with combinations of the intermediate transfer belt 6 and the first transfer rollers 5C and 5D having various resistances, the proper transfer bias that compensates for change in resistance of the intermediate transfer belt 6 and the first transfer rollers 5C and 5D due to change in an environmental condition can be determined based on the potential of the intermediate transfer belt 6 affected by the resistance of the first transfer rollers 5C and 5D, the recorded relations between the proper transfer bias and the potential of the intermediate transfer belt 6, or the relation between the proper transfer bias and the predicted surface resistivity of the intermediate transfer belt 6. Thus, the image forming apparatus 100A can determine the proper transfer bias with an improved precision that compensates for the change in resistance of the first transfer rollers 5C and 5D due to the change in the environmental condition affecting measurement of the potential of the intermediate transfer belt 6, providing improved image quality.

Figure 10:
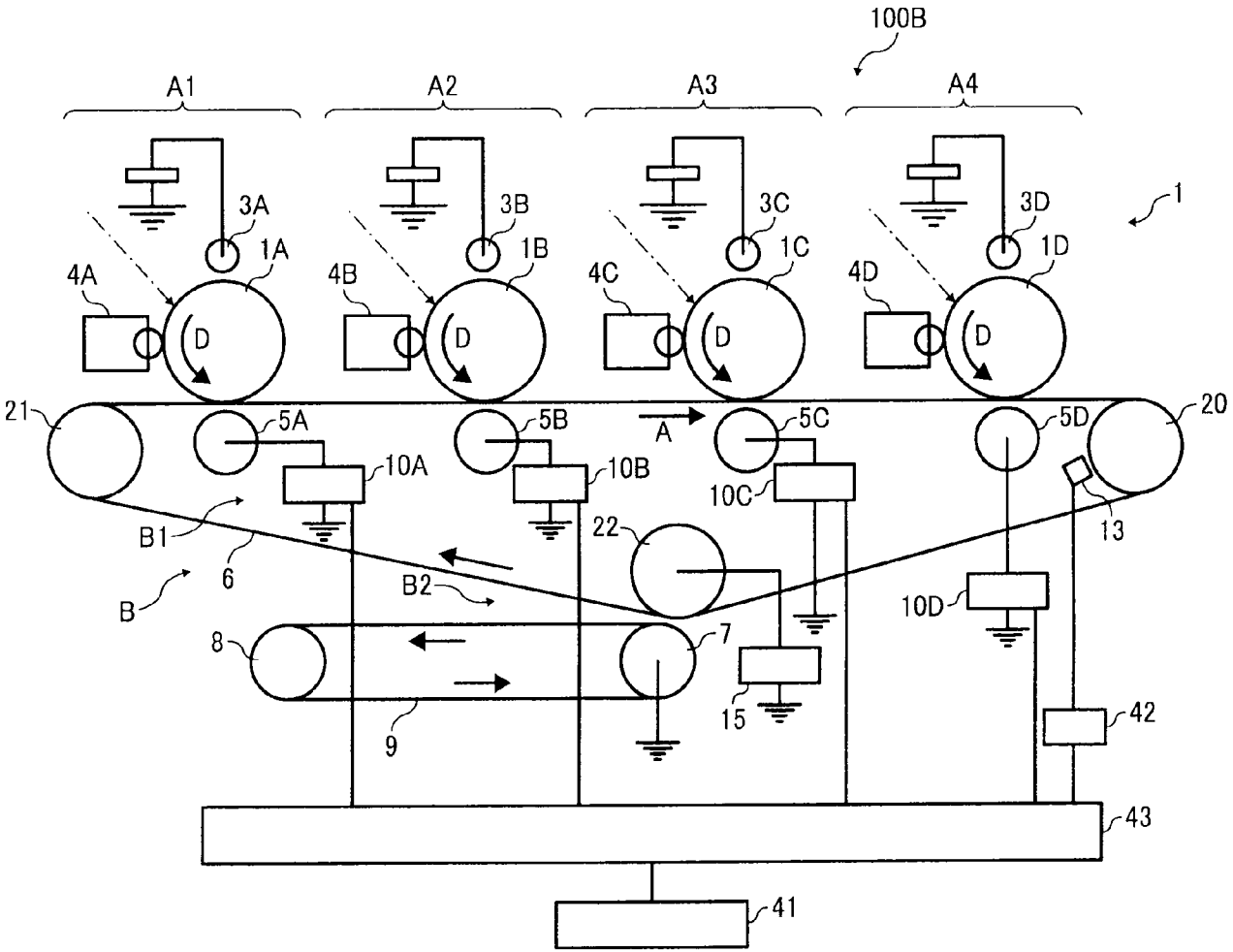
FIG. 10 is a schematic view of an image forming apparatus according to yet another exemplary embodiment of the present invention.

Referring to FIG. 10, the following describes an image forming apparatus 100B according to yet another exemplary embodiment. FIG. 10 is a schematic view of the image forming apparatus 100B. The image forming apparatus 100B does not include the conductive brush 11 and the metal plate 12 depicted in FIG. 1. The non-contact type surface potential sensor 13 is provided near the driving roller 20, serving as a conductor. The other elements of the image forming apparatus 100B are common to the image forming apparatus 100 depicted in FIG. 1.

The surface potential sensor 13 of the image forming apparatus 100B is identical with the surface potential sensor 13 of the image forming apparatus 100. The driving roller 20 serves as a conductor including metal. The driving roller 20 contacts the inner circumferential surface of the intermediate transfer belt 6 across the full width of the intermediate transfer belt 6.

Accordingly, the surface potential sensor 13 can measure an average potential of the intermediate transfer belt 6. Consequently, the conductive brush 11 and the metal plate 12 can be omitted in the image forming apparatus 100B, reducing manufacturing costs. The driving roller 20 is grounded via a switch during an image forming operation, and electrically floated when the potential of the intermediate transfer belt 6 is measured. An image forming operation and a process for determining a proper transfer bias performed in the image forming apparatus 100B are equivalent to the image forming operation and the process for determining the proper transfer bias performed in the image forming apparatus 100, and thereby descriptions about the image forming operation and the process for determining the proper transfer bias performed in the image forming apparatus 100B are omitted.

Figure 11:
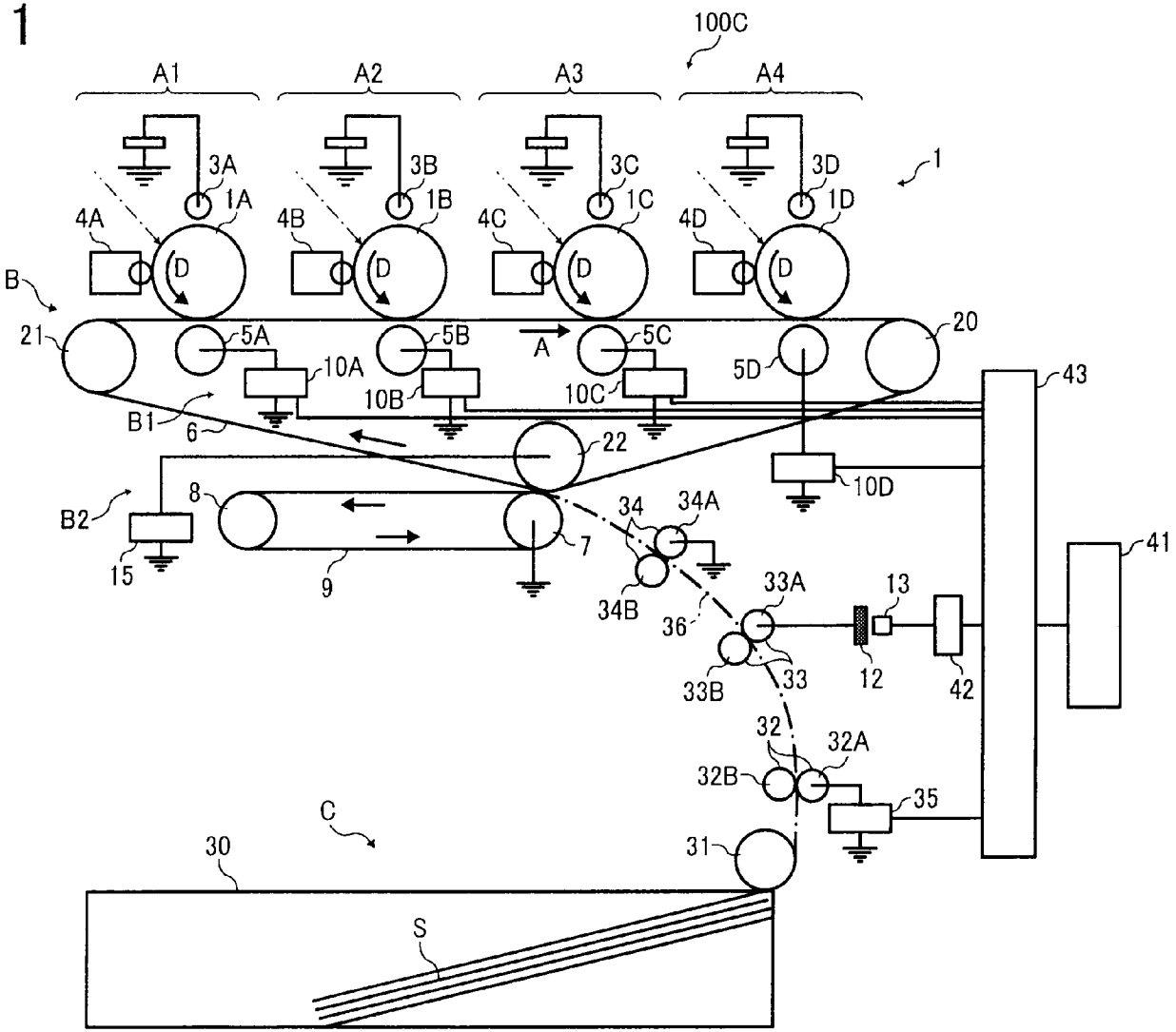
FIG. 11 is a schematic view of an image forming apparatus according to yet another exemplary embodiment of the present invention.

Referring to FIG. 11, the following describes an image forming apparatus 100C according to yet another exemplary embodiment. FIG. 11 is a schematic view of the image forming apparatus 100C. The image forming apparatus 100C includes a sheet supplier C and a power source 35. The sheet supplier C includes a paper tray 30, a feeding roller 31, conveyance roller pairs 32 and 33, a registration roller pair 34, and a conveyance path 36. The conveyance roller pair 32 includes rollers 32A and 32B. The conveyance roller pair 33 includes rollers 33A and 33B. The registration roller pair 34 includes rollers 34A and 34B. The image forming apparatus 100C does not include the conductive brush 11. The metal plate 12 and the surface potential sensor 13 are connected to the roller 33A of the conveyance roller pair 33. The power sources 10A, 10B, 10C, 10D, and 35 are connected to the controller 43. The other elements of the image forming apparatus 100C are common to the image forming apparatus 100 depicted in FIG. 1.

In the image forming apparatus 100, the first transfer rollers 5C and 5D serve as voltage appliers. However, in the image forming apparatus 100C, one of the conveyance roller pairs 32 and 33 serves as a voltage applier. The conveyance roller pairs 32 and 33 are provided on the conveyance path 36 connecting the paper tray 30 to the second transfer nip formed between the intermediate transfer belt 6 and the second transfer belt 9 to convey a transfer sheet S from the paper tray 30 to the second transfer nip. Further, in the image forming apparatus 100, the conductive brush 11, the metal plate 12, and the surface potential sensor 13, serving as a potential measurement device, measure the surface potential of the intermediate transfer belt 6. However, in the image forming apparatus 100C, the metal plate 12 and the surface potential sensor 13, serving as a potential measurement device, measure a surface potential of a transfer sheet S.

In the sheet supplier C, the paper tray 30 contains transfer sheets S serving as a transfer material and having a predetermined size (e.g., A4 size). The feeding roller 31 feeds the transfer sheets S loaded on the paper tray 30 one by one toward the registration roller pair 34 through the conveyance path 36 illustrated in a broken line in FIG. 11. A plurality of conveyance roller pairs, that is, two conveyance roller pairs 32 and 33 according to this exemplary embodiment, is provided on the conveyance path 36 with a predetermined distance provided between the conveyance roller pairs 32 and 33. The registration roller pair 34 feeds the transfer sheet S to the second transfer nip formed between the intermediate transfer belt 6 and the second transfer belt 9 at a proper time.

The power source 35, serving as a constant-voltage power source and a voltage applier, is electrically connected to the roller 32A, that is, one of rollers forming the conveyance roller pair 32 provided closer to the paper tray 30 than the conveyance roller pair 33 is. The power source 35 and the roller 32A serve as a voltage applier. The metal plate 12 and the surface potential sensor 13, serving as a potential measurement device, are connected to the roller 33A, that is, one of rollers forming the conveyance roller pair 33.

The potential measurement device includes the metal plate 12 and the surface potential sensor 13. The metal plate 12 has a rectangular plate shape and is connected to the roller 33A via a conductive material. A predetermined gap is provided between the metal plate 12 and the surface potential sensor 13, that is, a non-contact type sensor. When the transfer sheet S contacts both the conveyance roller pairs 32 and 33, the power source 35 applies a voltage to the transfer sheet S via the roller 32A and the surface potential sensor 13 measures a potential of the transfer sheet S via the roller 33A and the metal plate 12.

Figure 12:
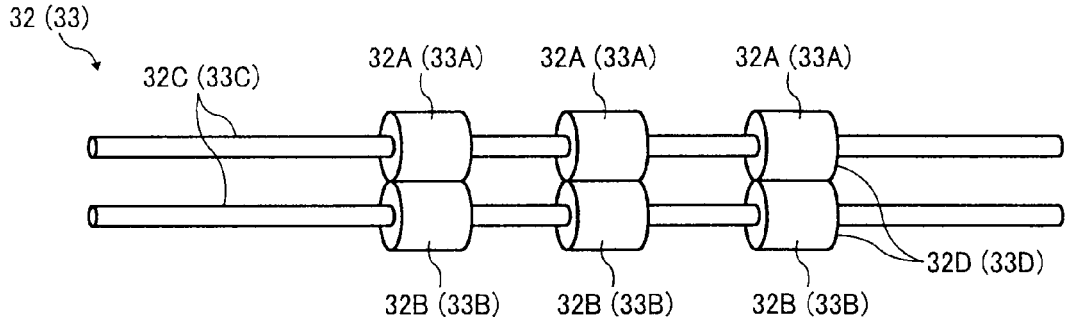
FIG. 12 is a perspective view of a conveyance roller pair included in the image forming apparatus shown in FIG. 11.

FIG. 12 is a perspective view of the conveyance roller pair 32 or 33. Each of the rollers 32A and 32B includes a shaft 32C and three roller bases 32D. Each of the rollers 33A and 33B includes a shaft 33C and three roller bases 33D. The description of the conveyance roller pair 33 is omitted because the conveyance roller pair 33 has a structure common to the conveyance roller pair 32.

The conveyance roller pair 32 includes the rollers 32A and 32B opposing each other. The roller 32A serves as a conductive roller and the roller 32B serves as a non-conductive roller. The roller bases 32D of the conductive roller 32A include a conductive rubber containing conductive carbon black. For example, at least an outer circumferential surface of the roller bases 32D, which contacts the transfer sheet S, includes the conductive rubber. A resistance of the conductive rubber is sufficiently lower than a resistance of the transfer sheet S. Preferably, the conductive rubber has a volume resistivity not greater than $10^6$ Ω·cm. On the contrary, the roller 32B may not be conductive, and thereby the roller bases 32D of the roller 32B may include either a conductive material or an insulative material. However, when an outer circumferential surface of the roller 32B has an electric resistance lower than an electric resistance of the transfer sheet S, an electric charge injected by the power source 35 depicted in FIG. 11 into the transfer sheet S via the conductive roller 32A may escape from the transfer sheet S via the roller 32B. To prevent this, at least the outer circumferential surface of the roller 32B has an electric resistance sufficiently greater than the electric resistance of the transfer sheet S, preferably, a volume resistivity not smaller than $10^{14}$ Ω·cm. Similarly, when an outer circumferential surface of the roller 33B has conductivity, the conductivity of the roller 33B may affect a potential measured by the conductive roller 33A. Therefore, the roller 33B preferably includes a high-resistance material having a volume resistivity not smaller than $10^{14}$ Ω·cm or an insulative material.

Figure 13:
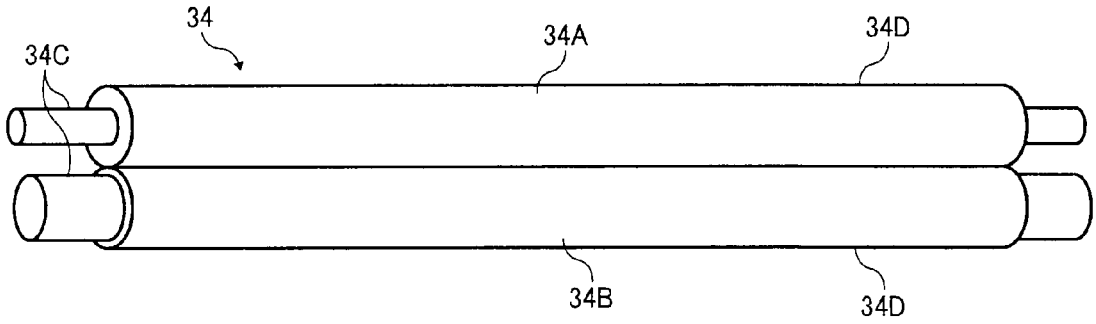
FIG. 13 is a perspective view of a registration roller pair included in the image forming apparatus shown in FIG. 11.

FIG. 13 is a perspective view of the registration roller pair 34. Each of the rollers 34A and 34B includes a shaft 34C and a roller base 34D.

Like the conveyance roller pairs 32 and 33 depicted in FIG. 12, the registration roller pair 34 includes the rollers 34A and 34B opposing each other. The roller 34A serves as a conductive roller and the roller 34B serves as a non-conductive roller. However, unlike in the conveyance roller pairs 32 and 33, in the registration roller pair 34, each of the rollers 34A and 34B includes one shaft 34C and one roller base 34D having a width slightly greater than a width of a transfer sheet S fed by the registration roller pair 34. The roller 34A, that is, one of rollers forming the registration roller pair 34, is grounded via a conductive material to quickly move an electric charge injected into the transfer sheet S by a voltage applied by the roller 32A and the power source 35, serving as a voltage applier, into the ground. Accordingly, the roller 34A is formed of a metal roller including stainless steel. Alternatively, the roller 34A may not be formed of the metal roller. For example, the roller 34A may include a rubber material or a resin material having a volume resistivity not greater than $10^6$ Ω·cm to quickly move the electric charge injected into the transfer sheet S into the ground. The roller 34B may include either a conductive material or an insulative material. However, an outer circumferential surface of the roller 34B preferably includes a resin material having elasticity, such as rubber, so that the registration roller pair 34 can nip the transfer sheet S effectively.

Figure 14:
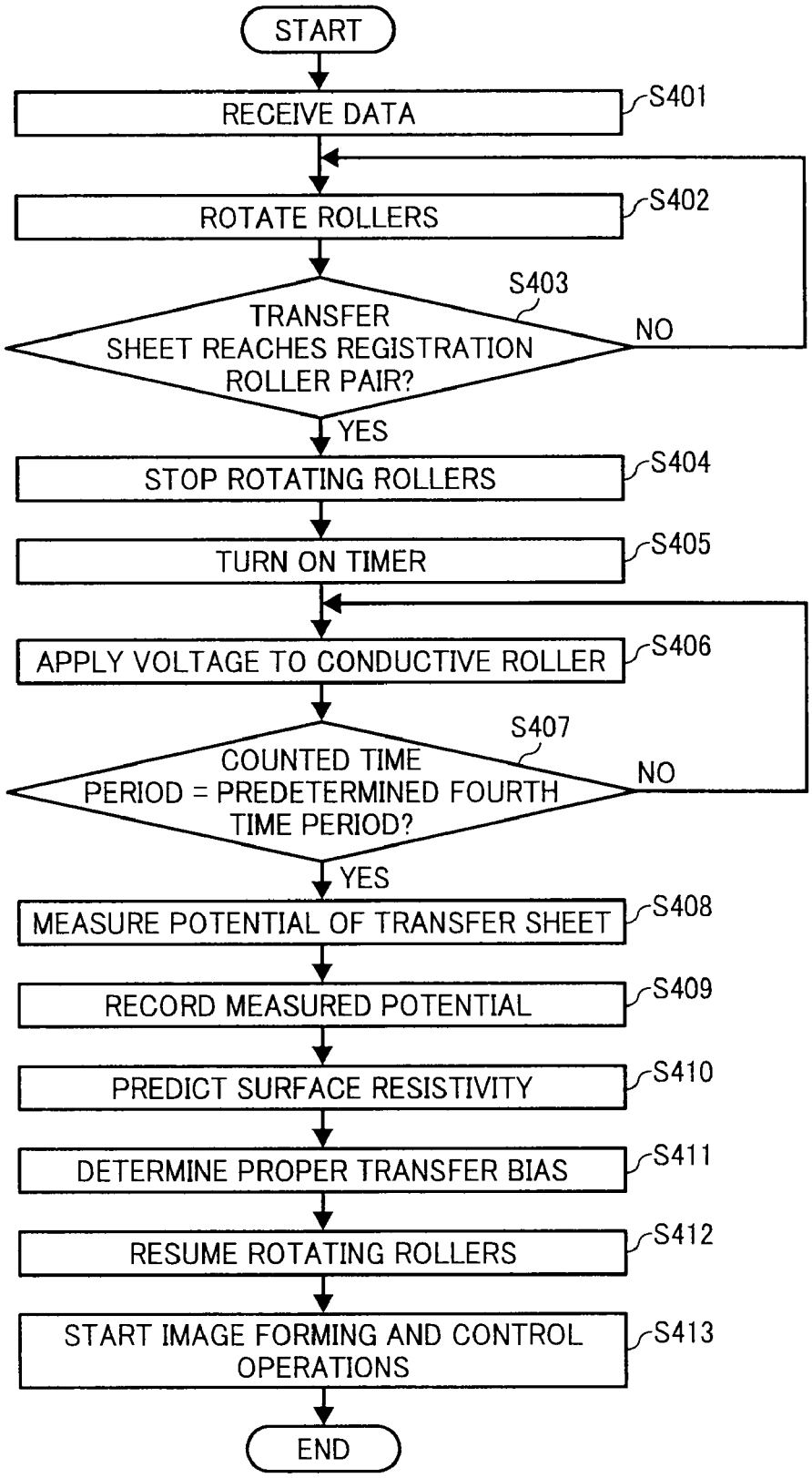
FIG. 14 is a flowchart illustrating a process for determining a proper transfer bias in the image forming apparatus shown in FIG. 11.

Referring to FIGS. 11 and 14, the following describes a process for determining a proper transfer bias in the image forming apparatus 100C depicted in FIG. 11. FIG. 14 is a flowchart illustrating the process for determining the proper transfer bias in the image forming apparatus 100C.

In step S401, the image forming apparatus 100C receives scanner data or print data. In step S402, the feeding roller 31 and the conveyance roller pairs 32 and 33 start rotating, and thereby the feeding roller 31 feeds transfer sheets S loaded on the paper tray 30 one by one toward the registration roller pair 34 via the conveyance roller pairs 32 and 33, so that the transfer sheet S is contacted and stopped by the registration roller pair 34. In step S403, the controller 43 determines whether or not the transfer sheet S reaches the registration roller pair 34. If the transfer sheet S reaches the registration roller pair 34 (e.g., if YES is selected in step S403), the feeding roller 31 and the conveyance roller pairs 32 and 33 stop rotating in step S404. In step S405, the timer 41 is turned on. In step S406, the power source 35 applies a predetermined voltage (e.g., 100 V) to the transfer sheet S via the conductive roller 32A. Simultaneously, the timer 41 starts counting a time period. The conductive roller 33A is grounded. Therefore, an electric charge injected by the conductive roller 32A into the transfer sheet S moves to the conductive roller 33A to increase a surface potential of the transfer sheet S. Consequently, a potential of the conductive roller 33A also increases. In step S407, the controller 43 determines whether or not the time period counted after the power source 35 applies the predetermined voltage reaches a predetermined fourth time period (e.g., 1.0 second). If the counted time period reaches the predetermined fourth time period (e.g., if YES is selected in step S407), the surface potential sensor 13 measures the surface potential of the transfer sheet S via the metal plate 12 in step S408. In step S409, the recording member 42 records the measured surface potential of the transfer sheet S. Prior examinations, such as experiments, may measure surface potentials of transfer sheets S having different surface resistivities, respectively, when the predetermined fourth time period elapses, so as to store the measured surface potentials into a database. In step S410, the surface resistivity of the transfer sheet S is predicted based on the measured surface potential of the transfer sheet S and the surface potentials stored in the database. In step S411, the controller 43 calculates and determines a proper transfer bias (e.g., a second transfer bias) to be applied by the counter roller 22 to transfer a toner image from the intermediate transfer belt 6 onto the transfer sheet S based on the predicted surface resistivity of the transfer sheet S. In step S412, the feeding roller 31 and the conveyance roller pairs 32 and 33 resume rotating. In step S413, the image forming apparatus 100C starts an image forming operation and other control operation.

In the flowchart shown in FIG. 14, the surface potential sensor 13 measures the surface potential of the transfer sheet S when the transfer sheet S stops. Alternatively, the surface potential sensor 13 may measure the surface potential of the transfer sheet S when the transfer sheet S is conveyed at a speed slower than a speed at which the transfer sheet S is conveyed during the image forming operation. In this case, measurement error may increase. Therefore, it is preferable to measure the surface potential of the transfer sheet S when the transfer sheet S stops.

Figure 15A:
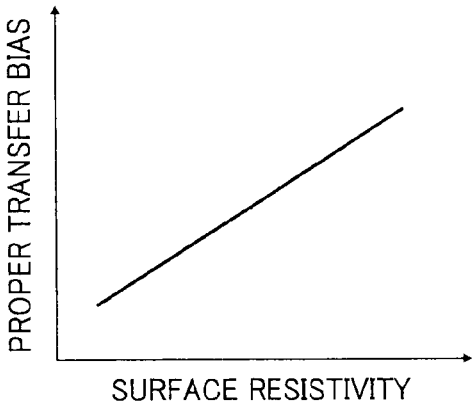
FIG. 15A is a graph illustrating a relation between a surface resistivity of a transfer sheet used in the image forming apparatus shown in FIG. 11 and a proper transfer bias.
Figure 15B:
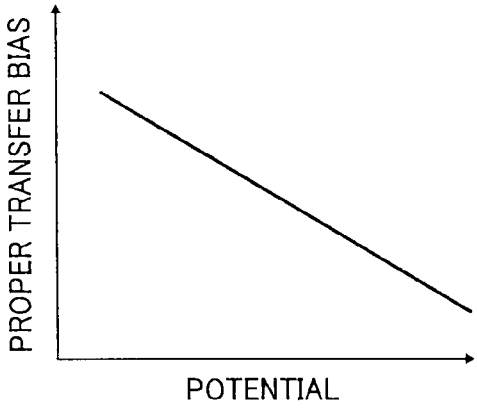
FIG. 15B is a graph illustrating a relation between a measured potential of a transfer sheet used in the image forming apparatus shown in FIG. 11 and a proper transfer bias.

FIG. 15A is a graph illustrating a relation between the surface resistivity of a transfer sheet S and the proper transfer bias. FIG. 15B is a graph illustrating a relation between the measured potential of a transfer sheet S and the proper transfer bias. The graph shown in FIG. 15A illustrates a general relation between the surface resistivity of the transfer sheet S and the proper transfer bias obtained by the above-described examinations. Similarly, the graph shown in FIG. 15B illustrates a general relation between the measured potential of the transfer sheet S and the proper transfer bias obtained by the above-described examinations. FIG. 15A shows a linear relation in which the surface resistivity of the transfer sheet S and the proper transfer bias are directly proportional. FIG. 15B shows a linear relation in which the measured potential of the transfer sheet S and the proper transfer bias are inversely proportional.

An increasing speed of the potential of the transfer sheet S varies depending on the surface resistivity of the transfer sheet S. The lower the surface resistivity is, the faster the increasing speed of the potential of the transfer sheet S is. Namely, the surface resistivity of the transfer sheet S can be predicted by measuring the increasing speed of the potential of the transfer sheet S or the potential of the transfer sheet S when a predetermined time period elapses after a voltage is applied. The proper transfer bias for forming an image is determined based on such relation and the measured potential or the surface resistivity of the transfer sheet S. Thus, the image forming apparatus 100C can provide an improved robustness against the resistance of the transfer sheet S varying depending on type of the transfer sheet S or an environmental condition of the image forming apparatus 100C.

Figure 16:
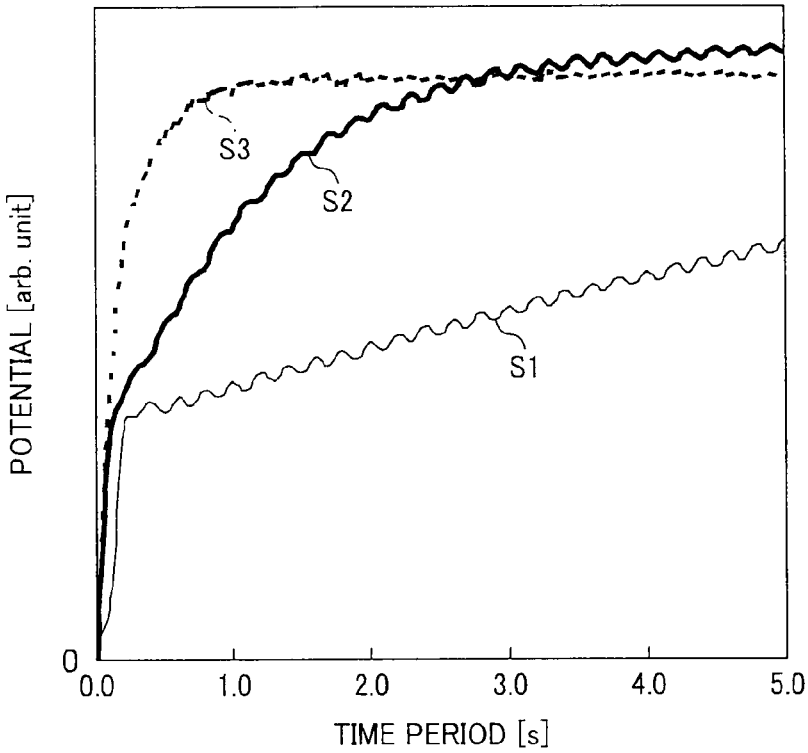
FIG. 16 is a graph illustrating a relation between a time period and a surface potential of three types of a transfer sheet used in the image forming apparatus shown in FIG. 11.

FIG. 16 is a graph illustrating the surface potential of three types of a transfer sheet S changing over time when the transfer sheets S have three different volume resistivities, respectively. In the graph shown in FIG. 16, a curve S1 represents a transfer sheet S having a surface resistivity of 2.5E+11Ω and a thickness of 90 μm. A curve S2 represents a transfer sheet S having a surface resistivity of 1.1E+11Ω and a thickness of 90 μm. A curve S3 represents a transfer sheet S having a surface resistivity of 5.0E+10Ω and a thickness of 240 μm.

The potential measurement device (e.g., the metal plate 12 and the surface potential sensor 13) measured the surface potential of the three types of a transfer sheet S having the three different volume resistivities, respectively, over time according to Japanese Industrial Standards JIS K6911. As illustrated in FIG. 16, when the transfer sheets S have the surface resistivities around $10^{11}$ Ω·cm, respectively, several seconds are needed for the surface potential of the three types of a transfer sheet S to saturate after the conductive roller 32A depicted in FIG. 11 applies a voltage. However, the three types of a transfer sheet S indicate different characteristics in a process to saturation, respectively. Namely, the graph shown in FIG. 16 indicates a relation in which the higher the surface resistivity is, the slower the speed for the surface potential of the transfer sheet S to reach saturation. According to such relation, the surface resistivity of the transfer sheet S can be predicted based on the potential of the transfer sheet S measured by the potential measurement device after a predetermined time period elapses.

Further, as illustrated in FIG. 15A, the surface resistivity of the transfer sheet S and the proper transfer bias show the directly proportional linear relation. Therefore, proper transfer biases of transfer sheets S having various surface resistivities can be obtained in advance in an experiment, for example, to store the obtained data into a database and retrieve a graphic curve from the stored data. Namely, the proper transfer bias can be determined based on the surface resistivity plotted on the graphic curve. For example, according to this exemplary embodiment, when one second elapses after a voltage is applied, the surface potential of the transfer sheet S is measured and the recording member 42 records the measured surface potential of the transfer sheet S. The controller 43 determines the proper transfer bias based on the recorded surface potential of the transfer sheet S. Thus, measuring the surface potential of the transfer sheet S once when the predetermined time period elapses can determine the proper transfer bias, shortening a time period needed before an image forming operation starts after the image forming apparatus 100C receives image data. Alternatively, the surface potential of the transfer sheet S may be measured for a plurality of times. Measuring the surface potential of the transfer sheet S for the plurality of times retrieves an increasing speed or an increasing curve of the surface potential of the transfer sheet S recorded by the recording member 42. Accordingly, the surface resistivity of the transfer sheet S can be predicted based on the retrieved data with an improved precision. However, a longer time period is needed to start an image forming operation.

Alternatively, the surface resistivity of the transfer sheet S may be predicted by measuring an electric current flowing between the conductive roller 32A and the metal roller 34A when a voltage is applied to the conductive roller 32A. However, under a condition that the transfer sheet S has a surface resistivity of $10^{11}$ Ω·cm, a distance between the conductive roller 32A and the metal roller 34A is 10 cm, the conductive roller 32A has a width of 10 cm, and a voltage of 100 V is applied to the conductive roller 32A, the electric current flowing between the conductive roller 32A and the metal roller 34A shows a relation of I=V/R=100/(1E9×0.1/0.1)=1E−7=0.1 μA. Accordingly, a high-precision ammeter capable of measuring a microelectric current is needed. The microelectric current may be affected by noise, generating increased measurement error. To address this, in the image forming apparatus 100C, the non-contact type surface potential sensor 13 measures the surface potential of the transfer sheet S and recognizes a slight difference in an amount of electric charge as an enlarged electric signal corresponding to the difference between the surface resistivities of the transfer sheet S. Especially, when elements provided around the surface potential sensor 13 include a resin to have a small electrostatic capacity, that is, when the elements are electrically floated, the surface potential sensor 13 can provide improved measurement sensitivity.

According to this exemplary embodiment, the surface potential sensor 13 is a non-contact type sensor. Alternatively, the surface potential sensor 13 may be replaced by a contact-type sensor or a contact-type high-voltage probe. When the surface potential sensor 13 is replaced by the contact-type sensor or probe, an amount of electric charge flowing into the sensor or the probe increases with respect to an amount of electric charge flowing inside a transfer sheet S, unless the sensor or the probe has a sufficiently high input impedance. Accordingly, the input impedance of the sensor or the probe may affect the measurement. When an A4 size sheet having a thickness of 100 μm and a volume resistivity of $10^{11}$ Ω·cm is used as a transfer sheet S, both edges of the transfer sheet S in a long direction of the transfer sheet S have a resistance represented by 1E9×0.293/100E−6/0.21=1.4E13Ω. Therefore, the contact-type sensor or probe may preferably have an input impedance having a resistance greater by about double-digit than the above resistance of the both edges of the transfer sheet S, that is, a resistance not smaller than $10^{15}$Ω.

Alternatively, the surface potential sensor 13 may be provided near a front surface or a back surface of a transfer sheet S. However, in this case, the transfer sheet S may be jammed. Moreover, the surface potential sensor 13 may measure a limited area on the transfer sheet S. Varied resistances of the transfer sheet S may also affect measurement of the surface potential sensor 13 and paper dust generated by the transfer sheet S may degrade sensitivity of the surface potential sensor 13. To address those, according to this exemplary embodiment, the conductive roller 33A is connected to the metal plate 12 via a conductive wire so that the surface potential sensor 13 measures a surface potential of the metal plate 12.

Alternatively, any member, having an arbitrary shape, other than the conductive rollers 32A and 33A may apply a voltage to a transfer sheet S and may contact the transfer sheet S to measure a potential of the transfer sheet S, as long as such member is a conductive member which can stably contact the transfer sheet S. However, change in position at which the conductive member applies a voltage to the transfer sheet S or change in contact area in which the conductive member contacts the transfer sheet S may cause variation in measurement of the surface potential sensor 13 and may cause the transfer sheet S to be jammed while the transfer sheet S is conveyed. To address those, according to this exemplary embodiment, the conductive rollers 32A and 33A are used to stably apply a voltage to the transfer sheet S, to stably measure the voltage of the transfer sheet S, and to prevent the transfer sheet S from being jammed. Further, the metal roller 34A is grounded to provide a path for stably supplying an electric current inside the transfer sheet S, resulting in measurement of the potential of the transfer sheet S with an improved reproduction. Thus, the image forming apparatus 100C can determine and apply a proper transfer bias under any temperature and humidity with any type of transfer sheet S, providing improved transfer efficiency and output of a high-quality image.

According to the above-described exemplary embodiments, each of the image forming apparatus 100 depicted in FIG. 1, the image forming apparatus 100A depicted in FIG. 8, the image forming apparatus 100B depicted in FIG. 10, and the image forming apparatus 100C depicted in FIG. 11 serves as a tandem-type image forming apparatus using the indirect transfer method. Alternatively, the above-described exemplary embodiments may be applied to an image forming apparatus using the direct transfer method.

Figure 17:
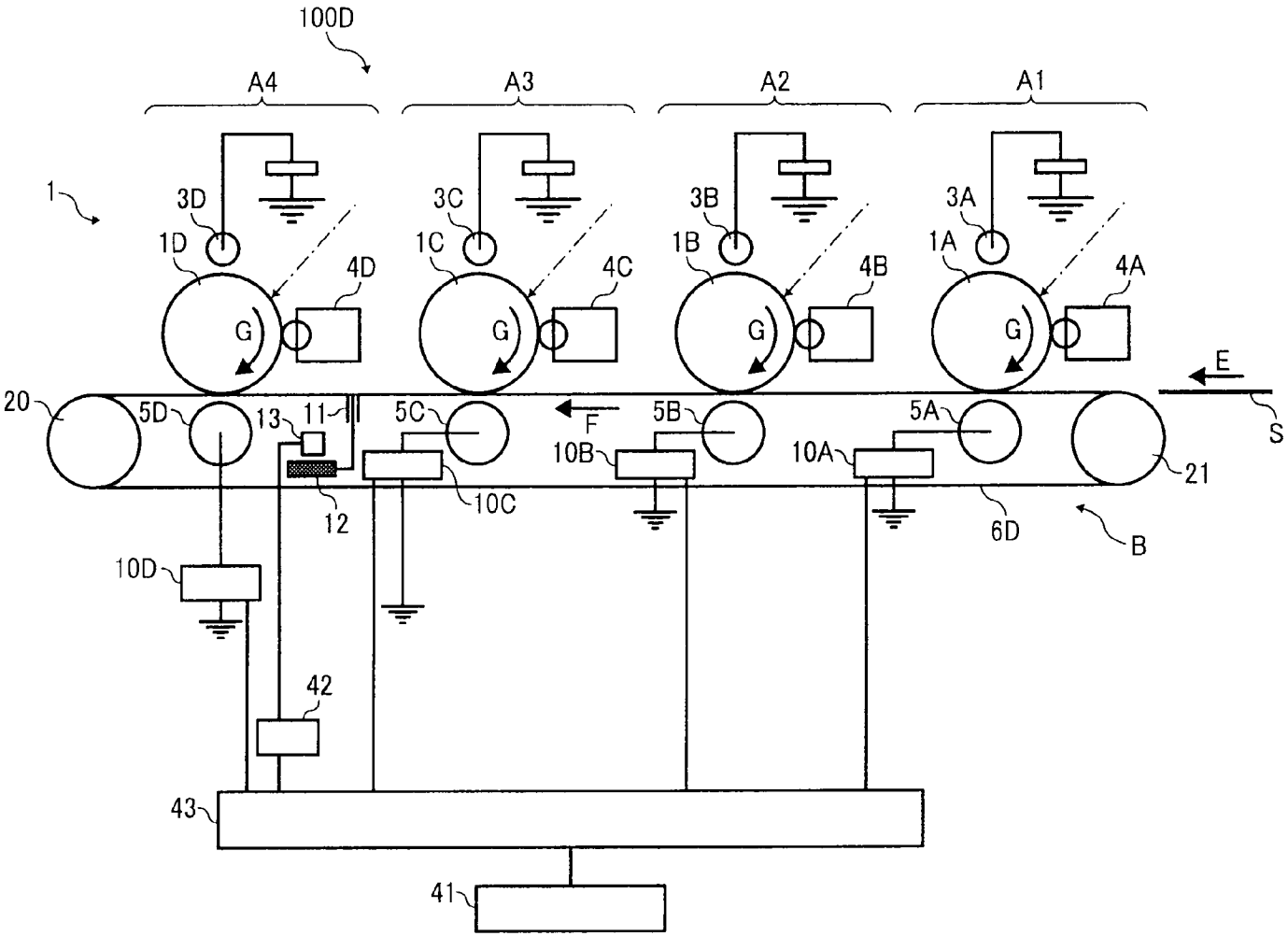
FIG. 17 is a schematic view of an image forming apparatus according to yet another exemplary embodiment of the present invention.

FIG. 17 is a schematic view of an image forming apparatus 100D using the direct transfer method according to yet another exemplary embodiment. In the image forming apparatus 100D, the transfer device B does not include the second transfer belt 9, the second transfer roller 7, the driven roller 8, the counter roller 22, and the power source 15 depicted in FIG. 1. The intermediate transfer belt 6 depicted in FIG. 1 is replaced by a conveyance belt 6D. The other elements of the image forming apparatus 100D are common to the image forming apparatus 100 depicted in FIG. 1.

The conveyance belt 6D is looped over the driving roller 20 and the driven roller 21 and conveys a transfer sheet S in a direction E to transfer nips at which toner images are transferred from the photoconductive drums 1A, 1B, 1C, and 1D onto the transfer sheet S conveyed by the conveyance belt 6D. Specifically, the first transfer rollers 5A, 5B, 5C, and 5D, serving as transfer members, apply transfer biases onto the conveyance belt 6D, serving as a transfer electric field generator, to generate a transfer electric field to transfer the toner images from photoconductive drums 1A, 1B, 1C, and 1D, serving as image carriers, and superimpose the toner images onto the transfer sheet S, serving as a toner image receiver. Thus, a color toner image is formed on the transfer sheet S.

The conductive brush 11, the metal plate 12, and the surface potential sensor 13, serving as a potential measurement device, measure a surface potential of the conveyance belt 6D.

Alternatively, the image forming apparatus 100D may further include the conductive brushes 16 and 17 and the switches 18 and 19 depicted in FIG. 8. Yet alternatively, the image forming apparatus 100D may not include the conductive brush 11 and the metal plate 12, and the surface potential sensor 13 may be provided near the driving roller 20 as illustrated in FIG. 10. Yet alternatively, the metal plate 12 and the surface potential sensor 13 may be connected to the sheet supplier C depicted in FIG. 11.

Namely, the above-described exemplary embodiments may be applied to any image forming apparatus including a transfer device in which one or more transfer members apply a transfer bias to an intermediate transfer belt, a conveyance belt, or a transfer sheet serving as a transfer electric field generator to transfer a toner image formed on an image carrier onto the intermediate transfer belt or the transfer sheet using the direct or indirect transfer method.

The exposure device, the image forming device 1, the sheet supplier C, the fixing device, the controller 43, the recording member 42, and the like according to the above-described exemplary embodiments are examples and may have other known structures and shapes to provide the above-described effects.

In an image forming apparatus (e.g., the image forming apparatus 100 depicted in FIG. 1, the image forming apparatus 100A depicted in FIG. 8, the image forming apparatus 100B depicted in FIG. 10, the image forming apparatus 100C depicted in FIG. 11, and the image forming apparatus 100D depicted in FIG. 17) according to the above-described exemplary embodiments, a potential measurement device (e.g., the conductive brush 11 depicted in FIGS. 1, 8, 10, and 17, and the metal plate 12 and the surface potential sensor 13 depicted in FIGS. 1, 8, 10, 11, and 17) measures a surface potential of a transfer electric field generator (e.g., the intermediate transfer belt 6 depicted in FIGS. 1, 8, and 10, the transfer sheet S depicted in FIG. 11, and the conveyance belt 6D in FIG. 17) when a predetermined time period elapses after a voltage applier (e.g., the first transfer rollers 5C and 5D depicted in FIGS. 1, 8, 10, and 17, the power sources 10C and 10D depicted in FIGS. 1, 8, 10, and 17, the counter roller 22 and the power source 15 depicted in FIGS. 1, 8, and 10, the power source 35 depicted in FIG. 11, and the roller 32A depicted in FIG. 11) applies a predetermined voltage to the transfer electric field generator. Based on the measured surface potential of the transfer electric field generator, the image forming apparatus determines a proper transfer bias to be applied by a transfer member (e.g., the first transfer rollers 5A, 5B, 5C, and 5D depicted in FIGS. 1, 8, 10, and 17 and the counter roller 22 depicted in FIGS. 1, 8, 10, and 11) to the transfer electric field generator to transfer a toner image onto a toner image receiver (e.g., the intermediate transfer belt 6 depicted in FIGS. 1, 8, 10, and 11 and the transfer sheet S depicted in FIGS. 1, 8, 10, 11, and 17). Therefore, change in electric resistance of the transfer electric field generator due to change in an environmental condition and deterioration of the transfer electric field generator over time may not prevent stable generation of a transfer electric field, resulting in output of a high-quality image.

The potential measurement device measures the surface potential of the transfer electric field generator while the transfer electric field generator stops moving or moves at a speed slower than a speed at which the transfer electric field generator moves during an image forming operation. Therefore, measurement error may not occur due to vibration of the transfer electric field generator. Accordingly, the potential measurement device can provide an improved measurement precision. Further, a surface resistivity of the transfer electric field generator can be predicted with an improved precision. Consequently, the image forming apparatus can determine a proper transfer bias.

The image forming apparatus further includes a recording member (e.g., the recording member 42 in FIGS. 1, 8, 10, 11, and 17) for recording the surface potential of the transfer electric field generator measured by the potential measurement device and a controller (e.g., the controller 43 depicted in FIGS. 1, 8, 10, 11, and 17) for controlling operations of the image forming apparatus. The recording member records the surface potential of the transfer electric field generator measured by the potential measurement device together with a time period counted by a timer (e.g., the timer 41 depicted in FIGS. 1, 8, 10, 11, and 17). Based on the measured surface potential of the transfer electric field generator and the counted time period, the controller determines a proper transfer bias to be applied by the transfer member to the transfer electric field generator to transfer a toner image. Therefore, the controller can recognize the surface potential of the transfer electric field generator as a function of time. Accordingly, the controller can predict the surface resistivity of the transfer electric field generator by comparing a curve plotted by the measured surface potentials of the transfer electric field generator and an increasing speed of the measured surface potentials of the transfer electric field generator with experimental data, so as to determine a proper transfer bias with an improved precision.

The potential measurement device includes a conductor (e.g., the conductive brush 11 depicted in FIGS. 1, 8, and 17, the driving roller 20 depicted in FIG. 10, the driven roller 21 depicted in FIG. 10, and the roller 33A depicted in FIG. 11) for contacting the transfer electric field generator and a non-contact type surface potential sensor (e.g., the surface potential sensor 13 depicted in FIGS. 1, 8, 10, 11, and 17) separated from the conductor with a predetermined gap provided between the surface potential sensor and the conductor. When the surface potential sensor is provided close to a belt member or a transfer material serving as the transfer electric field generator, toner particles adhered to the belt member or paper dust adhered to the transfer material may degrade measurement sensitivity of the surface potential sensor. To address this, the surface potential sensor does not contact the transfer electric field generator. Further, a general surface potential sensor measures a potential of the transfer electric field generator in a small area and is vulnerable to variation in resistance of the belt member. To address this, the surface potential sensor according to the above-described exemplary embodiments measures a potential of the conductor contacting the transfer electric field generator with a stable high sensitivity. Generally, a slight amount of electric charge is injected into the transfer electric field generator and thereby it is difficult to measure an amount of electric current. To address this, the non-contact type surface potential sensor according to the above-described exemplary embodiments does not allow the injected electric charge to escape from the transfer electric field generator. The surface potential of the transfer electric field generator is inversely proportional to an electrostatic capacity. Thus, the surface potential sensor measures the surface potential of the transfer electric field generator at a position having a small electrostatic capacity with a high sensitivity.

A general surface potential sensor measures a potential of the transfer electric field generator in a small area and is vulnerable to local variation in resistance of the transfer electric field generator including a non-uniform material. To address this, according to the above-described exemplary embodiments, the conductor contacts the transfer electric field generator across substantially a full width of the transfer electric field generator. Thus, the surface potential sensor can stably measure an average surface potential of the transfer electric field generator with an improved precision.

When a time period elapsed after the voltage applier applies a voltage reaches a predetermined second time period, the controller changes the voltage to be applied by the voltage applier to the transfer electric field generator. Namely, the potential of the transfer electric field generator changes transiently. Further, an electric field may affect a resistance of the transfer electric field generator when the transfer electric field generator includes some material. Considering those, the potential of the transfer electric field generator is measured while the applied voltage is changed, so as to predict the surface resistivity of the transfer electric field generator based on a curve plotted by the changed surface potentials of the transfer electric field generator. Accordingly, the surface resistivity of the transfer electric field generator can be predicted with an improved precision.

The voltage applier applies a voltage to the transfer electric field generator via an image carrier (e.g., the photoconductive drums 1A, 1B, 1C, and 1D depicted in FIGS. 1, 8, 10, and 17 and the intermediate transfer belt 6 depicted in FIGS. 1, 8, 10, and 11) or the transfer member. Therefore, a voltage application member (e.g., the conductive brushes 16 and 17 depicted in FIG. 8) is not needed, decreasing a number of elements and saving space.

The voltage applier includes the voltage application member, which is neither the image carrier nor the transfer member, for contacting the transfer electric field generator to apply a voltage to the transfer electric field generator. In other words, the voltage application member, other than the image carrier and the transfer member, applies a voltage to the transfer electric field generator. Therefore, a resistance of the image carrier or the transfer member may not affect measurement of the surface potential of the transfer electric field generator. Accordingly, a proper transfer bias can be determined more precisely.

The voltage applier includes a constant-voltage power source. A switch (e.g., the switches 18 and 19 depicted in FIG. 8) connects the constant-voltage power source to the voltage application member or the transfer member. Therefore, the resistance of the image carrier or the transfer member may not affect measurement of the surface potential of the transfer electric field generator. Also, the surface potential of the transfer electric field generator, which is affected by the resistance of the image carrier or the transfer member, can be measured. Accordingly, the surface resistivity of the transfer electric field generator can be predicted with an improved precision by considering affection of the resistance of the transfer member when the transfer member applies a transfer bias. Further, the image forming apparatus can determine a proper transfer bias to be applied by the transfer member to the transfer electric field generator to transfer a toner image.

As illustrated in FIG. 10, an intermediate transfer belt (e.g., the intermediate transfer belt 6) having an endless belt shape serves as the transfer electric field generator. A driving roller (e.g., the driving roller 20) for rotating the intermediate transfer belt or a driven roller (e.g., the driven roller 21) driven by the driving roller serves as the conductor. A surface potential sensor (e.g., the surface potential sensor 13) is provided inside a loop formed by the intermediate transfer belt in such a manner that a predetermined gap is provided between the surface potential sensor and one of the driving roller and the driven roller, decreasing a number of elements and reducing measurement error due to vibration of the intermediate transfer belt of which potential is measured. The driving roller or the driven roller contacts the intermediate transfer belt across substantially a full width of the intermediate transfer belt. Thus, an average surface potential of the intermediate transfer belt can be measured stably with an improved precision.

As illustrated in FIG. 11, a voltage applier (e.g., the power source 35) applies a voltage to a transfer material (e.g., a transfer sheet S), serving as the transfer electric field generator, via a conveyance roller (e.g., the roller 32A) for conveying the transfer material. Therefore, change in surface resistivity of the transfer material due to change in an environmental condition can be predicted. Thus, the change in the environmental condition may not affect generation of a stable transfer electric field, resulting in output of a high-quality image.

The voltage applier applies a voltage to the transfer electric field generator. When a predetermined time period elapses, the potential measurement device measures a surface potential of the transfer electric field generator. Based on the measured surface potential of the transfer electric field generator, the image forming apparatus determines a proper transfer bias to be applied by the transfer member to the transfer electric field generator to transfer a toner image. Even when a resistance of the intermediate transfer belt or the transfer material, serving as the transfer electric field generator, changes substantially under an environmental condition of high temperature and humidity or an environmental condition of low temperature and humidity, the proper transfer bias can be selected to transfer the toner image, providing an improved robust control against change in the environmental condition and formation of a high-quality image.

The voltage applier applies a voltage to the transfer electric field generator. When a predetermined time period elapses, the potential measurement device measures a surface potential of the transfer electric field generator. When another predetermined time period elapses, the voltage applied by the voltage applier is changed and the voltage applier applies the changed voltage to the transfer electric field generator. When yet another predetermined time period elapses, the potential measurement device measures the surface potential of the transfer electric field generator. A surface resistivity of the transfer electric field generator is predicted based on a curve plotted by the measured surface potentials of the transfer electric field generator. Accordingly, in addition to the above-described effects, even when the toner image receiver, serving as the transfer electric field generator, is affected by an electric field, the surface resistivity of the transfer electric field generator can be predicted with an improved precision. Further, a proper transfer bias can be selected to form a high-quality image.

One of the transfer members is used as the voltage applier to apply a voltage to the transfer electric field generator. When a predetermined time period elapses, the potential measurement device measures a surface potential of the transfer electric field generator. Then, the voltage application member is used as the voltage applier to apply a voltage to the transfer electric field generator. When a predetermined time period elapses, the potential measurement device measures the surface potential of the transfer electric field generator again. A proper transfer bias to be applied by the transfer member to the transfer electric field generator to transfer a toner image is determined to compensate for change in resistance of the transfer member based on the measured surface potentials of the transfer electric field generator. Namely, the proper transfer bias can be determined and applied with an improved precision to compensate for change in resistance of the transfer member, such as a first transfer roller (e.g., the first transfer rollers 5A, 5B, 5C, and 5D depicted in FIGS. 1, 8, 10, 11, and 17), due to change in an environmental condition affecting measurement of the surface potential of the transfer electric field generator, resulting in formation of a high-quality image.

The conveyance roller applies a voltage to the transfer material. When a predetermined time period elapses, the potential measurement device measures a surface potential of the transfer material. A surface resistivity of the transfer material is predicted based on the measured surface potential of the transfer material. Based on the predicted surface resistivity of the transfer material, a proper transfer bias to be applied by the transfer member to the transfer material to transfer a toner image is determined. Thus, change in surface resistivity of the transfer material due to change in an environmental condition can be predicted with an improved precision. Accordingly, a robust control can be provided against change in the environmental condition, resulting in formation of a high-quality image.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image carrier configured to carry a toner image; and a transfer device, including:

at least one transfer member configured to apply a transfer bias;

a transfer electric field bearer configured to receive the transfer bias applied by the at least one transfer member to generate a transfer electric field;

a toner image receiver configured to receive the toner image transferred from the image carrier by the transfer electric field generated;

a voltage applier configured to apply a predetermined voltage to the transfer electric field bearer;

a potential measurement device configured to measure a surface potential of the transfer electric field bearer when a predetermined time period elapses after the voltage applier applies the predetermined voltage to the transfer electric field bearer; and a controller configured to determine the transfer bias to be applied by the at least one transfer member to the transfer electric field bearer based on the measured surface potential of the transfer electric field bearer.

2. The image forming apparatus according to claim 1, wherein the potential measurement device measures the surface potential of the transfer electric field bearer when the transfer electric field bearer stops moving.

3. The image forming apparatus according to claim 1, wherein the potential measurement device measures the surface potential of the transfer electric field bearer when the transfer electric field bearer moves at a speed slower than a speed at which the transfer electric field bearer moves during an image forming operation.

4. The image forming apparatus according to claim 1, further comprising:

a recording member configured to record the surface potential of the transfer electric field bearer measured by the potential measurement device; and a timer configured to count a time period, wherein the recording member records the measured surface potential of the transfer electric field bearer together with the counted time period and the controller determines the transfer bias to be applied by the at least one transfer member to the transfer electric field bearer to transfer the toner image based on the measured surface potential of the transfer electric field bearer and the counted time period.

5. The image forming apparatus according to claim 1, wherein the potential measurement device includes:

a conductor configured to contact the transfer electric field bearer; and a non-contact type surface potential sensor separated from the conductor by a predetermined gap.

6. The image forming apparatus according to claim 5, wherein the conductor contacts the transfer electric field bearer across substantially a full width of the transfer electric field bearer.

7. The image forming apparatus according to claim 1, wherein the controller changes the voltage applied by the voltage applier to the transfer electric field bearer when a predetermined second time period elapses after the voltage applier applies the voltage to the transfer electric field bearer.

8. The image forming apparatus according to claim 1, wherein the voltage applier applies the voltage to the transfer electric field bearer via one of the image carrier and the at least one transfer member.

9. The image forming apparatus according to claim 1, wherein the voltage applier includes a voltage application member configured to contact the transfer electric field bearer to apply the voltage to the transfer electric field bearer.

10. The image forming apparatus according to claim 9, wherein the voltage applier further includes:

a constant-voltage power source; and a switch configured to connect the constant-voltage power source to one of the voltage application member and the at least one transfer member.

11. The image forming apparatus according to claim 5, wherein the transfer electric field bearer includes an intermediate transfer belt having an endless belt shape, and the conductor includes one of a driving roller configured to rotate the intermediate transfer belt and a driven roller driven by the driving roller, and wherein the surface potential sensor is provided inside a loop formed by the intermediate transfer belt in such a manner that the predetermined gap is provided between the surface potential sensor and the one of the driving roller and the driven roller of the conductor.

12. The image forming apparatus according to claim 1, wherein the transfer electric field bearer includes a transfer material and the transfer device further comprises a roller configured to feed the transfer material, and wherein the voltage applier applies the voltage to the transfer material via the roller.

13. An image forming method, comprising:

carrying a toner image with an image carrier;

applying a voltage to a transfer electric field bearer with a voltage applier;

measuring a surface potential of the transfer electric field bearer with a potential measurement device when a predetermined first time period elapses after the voltage applier applies the voltage to the transfer electric field bearer;

determining a transfer bias to be applied by at least one transfer member to the transfer electric field bearer based on the measured surface potential of the transfer electric field bearer;

applying the transfer bias to the transfer electric field bearer with the at least one transfer member;

generating a transfer electric field by the transfer bias applied by the at least one transfer member with the transfer electric field bearer; and transferring the toner image from the image carrier onto a toner image receiver with the transfer electric field.

14. The image forming method according to claim 13, further comprising:

before determining the transfer bias to be applied by the at least one transfer member, changing the voltage to be applied by the voltage applier when a second time period elapses after the voltage applier applies the voltage to the transfer electric field bearer;

applying the voltage changed when the second time period elapses to the transfer electric field bearer with the voltage applier;

measuring the surface potential of the transfer electric field bearer with the potential measurement device when the predetermined first time period elapses after the voltage applier applies the voltage changed when the second time period elapses to the transfer electric field bearer; and predicting a surface resistivity of the transfer electric field bearer based on a curve plotted by the measured surface potentials of the transfer electric field bearer.

15. The image forming method according to claim 13, wherein the transfer electric field bearer includes a transfer material, and the voltage applier applies the voltage to the transfer material via a roller configured to convey the transfer material, and wherein the transfer bias to be applied by the at least one transfer member to the transfer material is determined based on a surface resistivity of the transfer material predicted based on the measured surface potential of the transfer material.

16. An image forming method, comprising:

carrying a toner image with an image carrier;

applying a voltage to a transfer electric field bearer with a voltage application member serving as a voltage applier and contacting the transfer electric field bearer;

measuring a surface potential of the transfer electric field bearer with a potential measurement device when a predetermined first time period elapses after the voltage application member applies the voltage to the transfer electric field bearer;

connecting a constant-voltage power source to at least one transfer member using a switch to change the voltage applier from the voltage application member to the at least one transfer member;

applying a voltage to the transfer electric field bearer with the at least one transfer member;

measuring the surface potential of the transfer electric field bearer again with the potential measurement device when a predetermined second time period elapses after the at least one transfer member applies the voltage to the transfer electric field bearer;

determining a transfer bias to be applied by the at least one transfer member to the transfer electric field bearer based on the measured surface potentials of the transfer electric field bearer that compensates for change in resistance of the at least one transfer member;

applying the transfer bias to the transfer electric field bearer with the at least one transfer member;

generating a transfer electric field by the transfer bias applied by the at least one transfer member to the transfer electric field bearer; and transferring the toner image from the image carrier onto a toner image receiver with the transfer electric field.

* * * * *